US006320822B1

(12) United States Patent
Okeya et al.

(10) Patent No.: US 6,320,822 B1
(45) **Date of Patent: *Nov. 20, 2001**

(54) ELECTRONIC EQUIPMENT AND CONTROL METHOD FOR ELECTRONIC EQUIPMENT

(75) Inventors: Makoto Okeya, Shimosuwa-machi; Teruhiko Fujisawa, Shiojiri; Hiroshi Yabe, Shiojiri; Joji Kitahara, Shiojiri; Hiroyuki Kojima, Shiojiri; Noriaki Shimura, Shiojiri, all of (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/341,896

(22) PCT Filed: Nov. 20, 1998

(86) PCT No.: PCT/JP98/05257

§ 371 Date: Aug. 26, 1999

§ 102(e) Date: Aug. 26, 1999

(87) PCT Pub. No.: WO99/27423

PCT Pub. Date: Jun. 3, 1999

(30) Foreign Application Priority Data

Nov. 20, 1997 (JP) ..... 9-319838

(51) Int. Cl.[7] ..... G04B 9/00; G04B 1/00; H01H 35/00

(52) U.S. Cl. ..... 368/66; 368/204; 307/121; 307/130

(58) Field of Search ..... 368/10, 64, 66, 368/203–204; 307/116, 119, 121, 125, 126, 130

(56) References Cited

U.S. PATENT DOCUMENTS 5,767,594 * 6/1998 Cheng ..... 307/125
6,061,304 5/2000 Nagata et al. .

FOREIGN PATENT DOCUMENTS 0 855 633 7/1998 (EP) .
53-89471 8/1978 (JP) .

(List continued on next page.)

*Primary Examiner*—Vit Miska
(74) *Attorney, Agent, or Firm*—Mark P. Watson

(57) ABSTRACT

Portable electronic equipment includes a carried-by-user detector for detecting whether the electronic equipment is in a state carried by a user or not. When the electronic equipment is in a state not carried by the user, i.e., when the user is not employing the electronic equipment, an operating mode is shifted from a normal operating mode to a power saving mode to reduce power consumption of the electronic equipment. Useless consumption of power during non-use of the electronic equipment can be thus reduced. Further, in electronic equipment (timepiece) incorporating a power generator for generating power by converting first energy (motion, pressure or heat) into electric energy as second energy, whether the power generator is generating power, i.e., whether the electronic equipment is carried by the user, is detected by a power generation detecting circuit, and when a non-power-generation time exceeds a predetermined time, the operating mode is shifted to the power saving mode, thereby reducing power consumption. Accordingly, the electronic equipment (timepiece) can be provided with which when the electronic equipment is in the state not carried by the user or when the electronic equipment is in the state not carried by the user and in a state of not generating power, the operating mode of the electronic equipment is shifted to the power saving mode and energy can be saved without inconveniencing the user.

55 Claims, 14 Drawing Sheets

FOREIGN PATENT DOCUMENTS

| | | |
|---|---|---|
| 58-60277 | 4/1983 | (JP) . |
| 2-266289 | 10/1990 | (JP) . |
| 3-241927 | 10/1991 | (JP) . |
| 5-60075 | 9/1993 | (JP) . |
| 8-278380 | 10/1996 | (JP) . |
| 9-304555 | 11/1997 | (JP) . |
| 10-28069 | 1/1998 | (JP) . |
| 98/00613 | 1/1998 | (WO) . |
| WO98/06013 | 2/1998 | (WO) . |

* cited by examiner

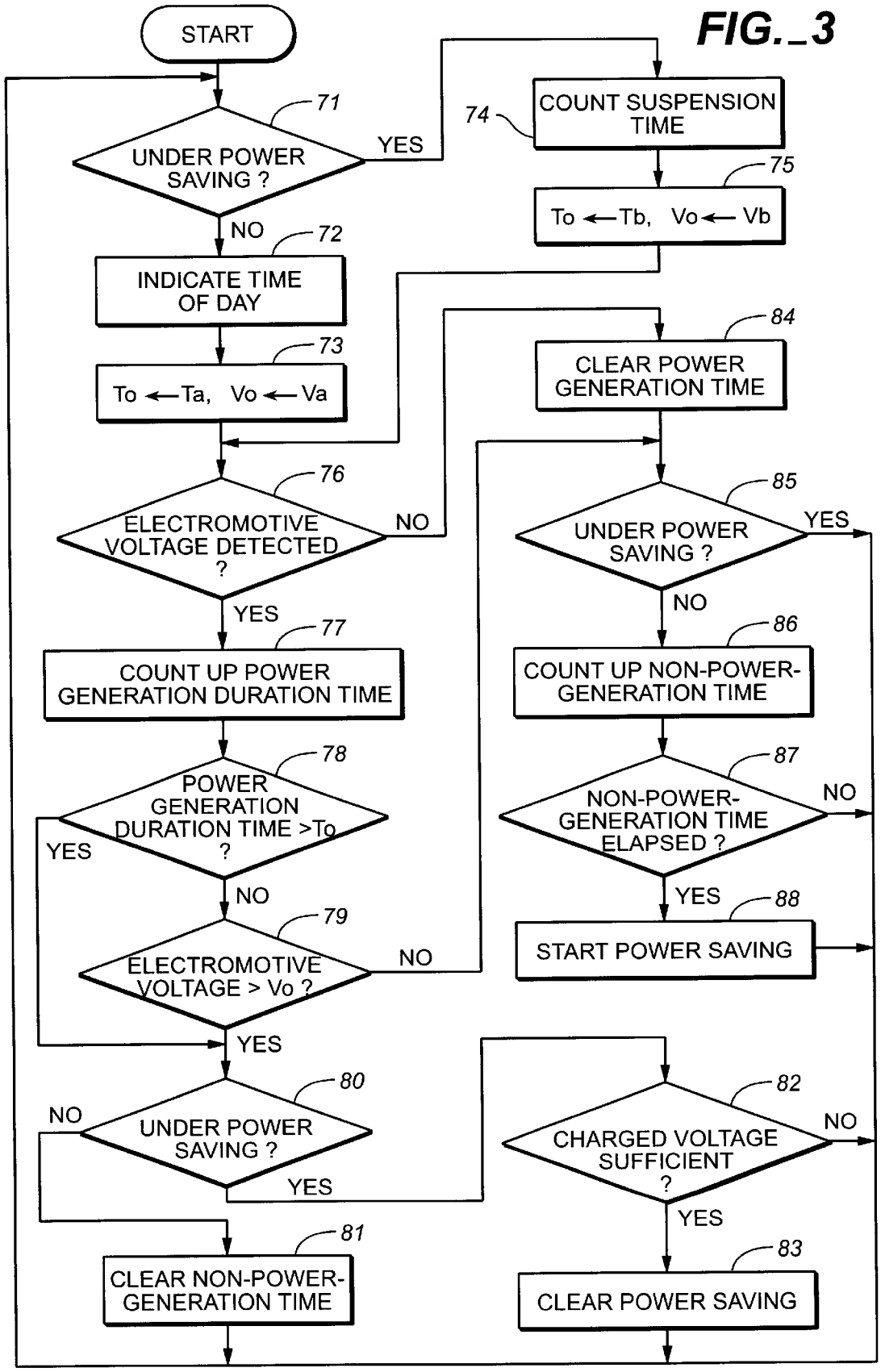
FIG._3
START
71
UNDER POWER SAVING ?
YES
NO
72
INDICATE TIME OF DAY
73
To ← Ta, Vo ← Va
74
COUNT SUSPENSION TIME
75
To ← Tb, Vo ← Vb
76
ELECTROMOTIVE VOLTAGE DETECTED ?
NO
YES
77
COUNT UP POWER GENERATION DURATION TIME
78
POWER GENERATION DURATION TIME >To ?
YES
NO
79
ELECTROMOTIVE VOLTAGE > Vo ?
NO
YES
80
UNDER POWER SAVING ?
NO
YES
81
CLEAR NON-POWER-GENERATION TIME
84
CLEAR POWER GENERATION TIME
85
UNDER POWER SAVING ?
YES
NO
86
COUNT UP NON-POWER-GENERATION TIME
87
NON-POWER-GENERATION TIME ELAPSED ?
NO
YES
88
START POWER SAVING
82
CHARGED VOLTAGE SUFFICIENT ?
NO
YES
83
CLEAR POWER SAVING

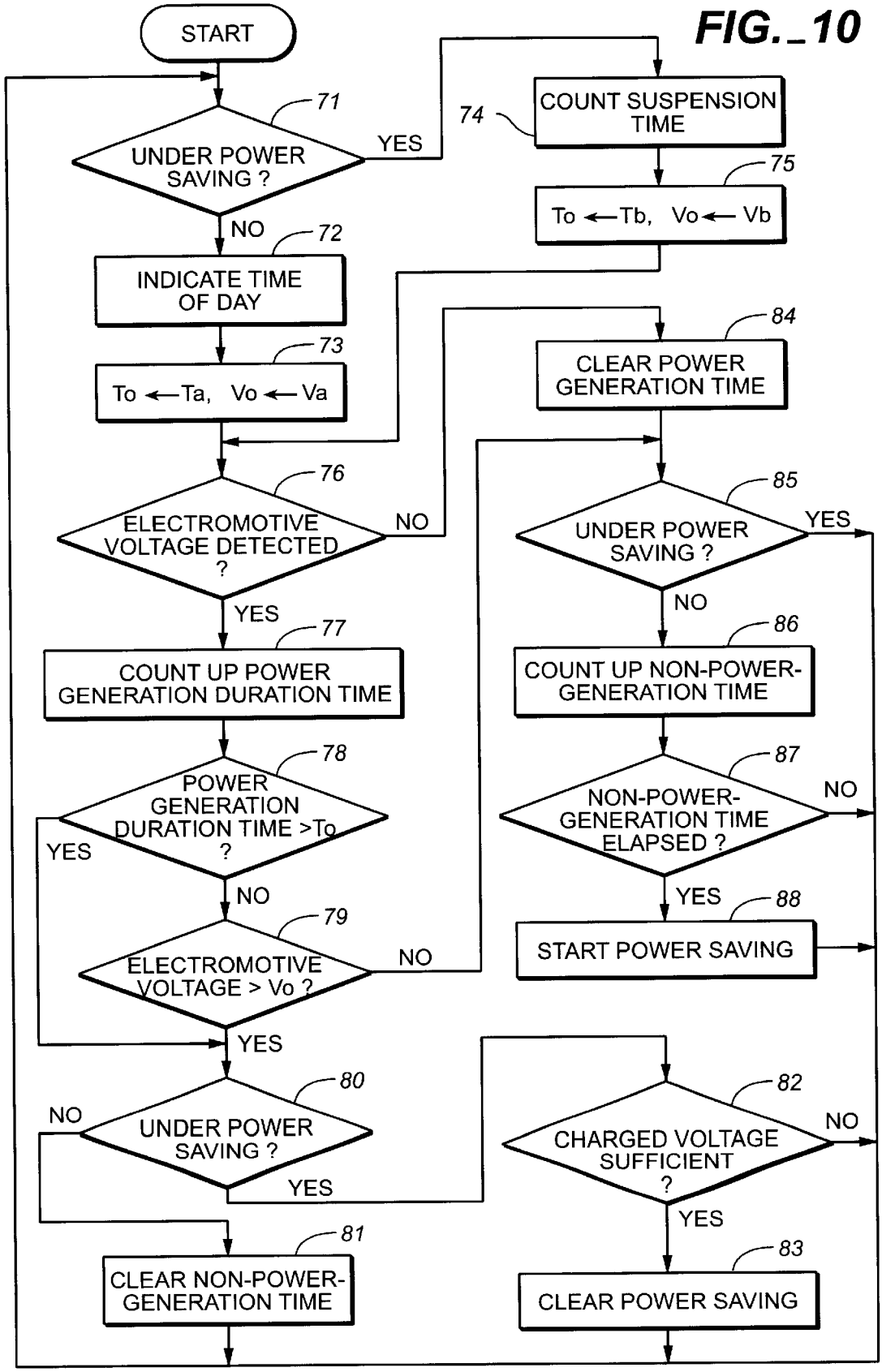
FIG._10
START
71
UNDER POWER SAVING ?
YES
NO
72
INDICATE TIME OF DAY
73
To ← Ta, Vo ← Va
74
COUNT SUSPENSION TIME
75
To ← Tb, Vo ← Vb
76
ELECTROMOTIVE VOLTAGE DETECTED ?
NO
YES
77
COUNT UP POWER GENERATION DURATION TIME
78
POWER GENERATION DURATION TIME >To ?
YES
NO
79
ELECTROMOTIVE VOLTAGE > Vo ?
NO
YES
80
UNDER POWER SAVING ?
NO
YES
81
CLEAR NON-POWER-GENERATION TIME
84
CLEAR POWER GENERATION TIME
85
UNDER POWER SAVING ?
YES
NO
86
COUNT UP NON-POWER-GENERATION TIME
87
NON-POWER-GENERATION TIME ELAPSED ?
NO
YES
88
START POWER SAVING
82
CHARGED VOLTAGE SUFFICIENT ?
NO
YES
83
CLEAR POWER SAVING

ELECTRONIC EQUIPMENT AND CONTROL METHOD FOR ELECTRONIC EQUIPMENT

BACKGROUND OF THE INVENTION

1. Technical Field

The present invention relates to portable electronic equipment and a control method for the electronic equipment, and in particular to electronic equipment and a control method for the electronic equipment with which a power saving mode and a normal operating mode can be switched over depending on a condition of use of the electronic equipment by the user. More specifically, the present invention relates to a timepiece and a control method for the timepiece which can indicate the time with high accuracy for a long time without replacing a battery.

2. Background Art

Recently, small size electronic watches such as wristwatches incorporating power generators, e.g., solar cells, and operating with no need of replacing batteries, have been developed as one form of electronic equipment. Those electronic watches have a function of charging electric power generated by power generators in large-capacity capacitors, and indicate the time with the power discharged from the capacitor when power is not generated. The electronic watches can therefore operate with stability for a long time without batteries. In consideration of the inconvenience of replacing batteries and a problem in disposal of exhausted batteries, it is expected that power generators will be incorporated in more and more electronic watches in future.

Meanwhile, a power generator incorporated in a wristwatch, etc. comprises a solar cell for converting irradiated light into electric energy, or a power generating system for converting kinetic energy, e.g. produced upon motion of the user's arm, into electric energy. Such a power generator is very advantageous in utilizing energy in the user's environment for conversion into electric energy, but has problems in that useable energy density is low and energy cannot be obtained in continuous fashion. Accordingly, power generation can not be performed in a continuous fashion, and the electronic watch operates with the power accumulated in a large-capacity capacitor while the power generation is suspended. For this reason, a large-capacity capacitor is desired, with a capacity as large as possible. A capacitor having too large a size however would raise problems that such a capacitor cannot be accommodated in a wristwatch device, and a proper level of voltage is hard to obtain because a longer time is required for charging the capacitor. On the other hand, if the capacity is too small, the electronic watch would stop operation when power is not generated for a long time. Even if the electronic watch is started again by, for example, irradiating light, the indicated time would be wrong and the precise time would not be indicated. Thus the electronic watch would not fulfill its function.

In a wristwatch device using a solar cell, because the intensity of ambient illumination can be detected with the solar cell, a system is conceived in which when the illumination intensity lowers below a setting value, the time indication is stopped but the time from when indication is stopped is continuously counted by an internal counter, and when the illumination intensity rises, the time indication is resumed and the current time is restored based on a value of the internal counter. With such a wristwatch device, the operation of indicating the time is stopped and energy is saved when the illumination is darkened, e.g., while the user is sleeping, and the time indication is automatically resumed and the current time is restored when it becomes light, e.g. in the morning. Accordingly, the duration of the large-capacity capacitor can be prolonged and the wristwatch can be operated for a long time without inconveniencing the user. Also, by designing a system such that the day-of-time indication is stopped after a certain period of time has elapsed subsequent to a lowering of the illumination intensity, the time can be continuously indicated even if the illumination intensity lowers for a short time as occurs when the wristwatch is hidden under clothes. This system can also save energy without inconveniencing the user.

However, the user often desires to see the time even during the night, and it is inconvenient if the user cannot know the current time instantly on such an occasion. Also, the wristwatch is often not exposed to the sun in the winter during which the user is wearing a coat or the like. If the time indication is stopped under such a condition, the function of the wristwatch is not fulfilled. Conversely, when the user does not wear the wristwatch and leaves it in the room, the time indication continues since the wristwatch is exposed to weak light. This results in wasteful power consumption.

An object of the present invention is therefore to provide electronic equipment and a control method for the electronic equipment with which a power saving mode and a normal operating mode can be switched over depending on a condition of use of the electronic equipment by the user.

Another object of the present invention is to provide a timepiece and a control method for the timepiece which can indicate the time with high accuracy for a long time without replacing a battery.

DISCLOSURE OF THE INVENTION

To achieve the above objects, the present invention is featured in portable electronic equipment comprising a power supply device capable of accumulating electric energy, a driven device driven with electric power supplied from the power supply device, a carried-by-user detector for detecting whether the electronic equipment is being carried by a user or not, and a mode shift control device for shifting an operating mode of the driven device from a normal operating mode to a power saving mode in accordance with a detection result of the carried-by-user detector when the electronic equipment is not carried by the user, to thereby reduce power consumption of the driven device.

Further, the power supply device in the present invention includes a power generator for generating electric power by converting first energy into the electric energy as second energy, and is able to accumulate the generated power.

Further, the carried-by-user detector in the present invention detects whether the electronic equipment is being carried by the user or not in accordance with a power generation state of the power generator.

Also, the present invention comprises an operating condition restoring device which, when the operating mode is restored to the normal mode again after a shift to the power saving mode, restores an operating condition of the driven device to the same operating condition which would have resulted in the case of operating the driven device continuously for a period of time from the shift to the power saving mode to the time of restoring to the normal mode.

Also, the mode shift control device in the present invention shifts the operating mode to the power saving mode before an amount of power accumulated in the power supply device becomes less than a predetermined amount of power required which is set beforehand and corresponds to the amount of power required for the restoring of the operating condition.

Also, the carried-by-user detector in the present invention detects the carried state of the electronic equipment based on an electromotive voltage produced in the power generator.

Also, the carried-by-user detector in the present invention compares an electromotive voltage produced in the power generator with a plurality of setting voltage values, and detects the carried state of the electronic equipment in accordance with a comparison result.

Further, the carried-by-user detector in the present invention detects the carried state of the electronic equipment by selecting one of the plurality of setting voltage values depending on the current mode, and compares the electromotive voltage produced in the power generator with the selected setting voltage value.

Further, the carried-by-user detector in the present invention sets the setting voltage value, which is used for determining whether the operating mode is to be shifted from the power saving mode to the normal operating mode, to be higher than the setting voltage value used for determining whether the operating mode is to be shifted from the normal operating mode to the power saving mode.

Also, the carried-by-user detector in the present invention detects the carried state of the electronic equipment based on a charging current in the power supply device.

Further, the carried-by-user detector in the present invention compares the charging current in the power supply device with a plurality of setting current values, and detecting the carried state of the electronic equipment in accordance with a comparison result.

Further, the carried-by-user detector in the present invention detects the carried state of the electronic equipment by selecting one of the plurality of setting current values depending on the current mode, and comparing the charging current in the power supply device with the selected setting current value.

Further, the carried-by-user detector in the present invention sets the setting current value, which is used for the mode shift from the power saving mode to the normal operating mode, to be higher than the setting current value used for the shift from the normal operating mode to the power saving mode.

Also, the carried-by-user detector in the present invention detects the carried state of the electronic equipment based on a power generation duration time of the power generator.

Further, the carried-by-user detector in the present invention compares the power generation duration time of the power generator with a plurality of setting time values, and detecting the carried state of the electronic equipment in accordance with a comparison result.

Further, the carried-by-user detector in the present invention detects the carried state of the electronic equipment by selecting one of the plurality of setting time values depending on the current mode, and comparing the power generation duration time of the power generator with the selected setting time value.

Further, the carried-by-user detector in the present invention sets the setting time value, which is used for the mode shift from the power saving mode to the normal operating mode, to be longer than the setting time value used for the shift from the normal operating mode to the power saving mode.

Also, the carried-by-user detector in the present invention detects the carried state of the electronic equipment based frequency of the power generated by the power generator.

Further, the carried-by-user detector in the present invention detects the frequency of the power generated by the power generator by counting the number of peaks of an electromotive voltage produced in the power generator during a period until a setting time elapses from a point in time at which the electromotive voltage has exceeded a setting voltage value.

Further, the carried-by-user detector in the present invention compares the frequency of the power generated by the power generator with a plurality of setting frequency values, and detects the carried state of the electronic equipment in accordance with a comparison result.

Further, the carried-by-user detector in the present invention detects the carried state of the electronic equipment by selecting one of the plurality of setting frequency values depending on the current mode, and compares the frequency of the power generated by the power generator with the selected setting frequency value.

Also, the carried-by-user detector in the present invention sets the setting frequency value, which is used for determining whether the operating mode is to be shifted from the power saving mode to the normal operating mode, to be higher than the setting frequency value used for determining whether the operating mode is to be shifted from the normal operating mode to the power saving mode.

Also, the power generator in the present invention includes a plurality of auxiliary power generators for converting the first energy in different forms.

Also, the first energy in the present invention is any of kinetic energy, pressure energy or thermal energy.

Also, the power generator in the present invention generates AC electric power by converting kinetic energy as the first energy into electric energy, and the power supply device rectifies and accumulates the generated AC power.

Further, the carried-by-user detector in the present invention comprises switching means being switched over in accordance with a cycle of the AC power generated by the power generator, a capacity element for accumulating electric charges in accordance with the switching operation of the switching means, discharge means inserted in a discharge path of the capacity element and discharging the electric charges accumulated in the capacity element, a measuring portion for counting the power generation duration time by measuring a period of time during which a voltage across the capacity element exceeds a predetermined value, and a carried-by-user detecting portion for detecting the carried state of the electronic equipment based on the power generation duration time.

Also, the carried-by-user detector in the present invention detects the carried state of the electronic equipment based on the frequency of the power generated by the power generator.

Further, the carried-by-user detector in the present invention detects the frequency of the power generated by the power generator by counting the number of peaks of an electromotive voltage produced in the power generator during a period until a setting time elapses from a point in time at which the electromotive voltage has exceeded a setting voltage value.

Further, the carried-by-user detector in the present invention compares the frequency of the power generated by the power generator with a plurality of setting frequency values, and detects the carried state of the electronic equipment in accordance with a comparison result.

Further, the carried-by-user detector in the present invention detects the carried state of the electronic equipment by selecting one of the plurality of setting frequency values depending on the current mode, and compares the frequency of the power generated by the power generator with the selected setting frequency value.

Also, the power generator in the present invention comprises a rotating weight undergoing swing motion, and a power generation element for generating electromotive forces with the rotary motion of the rotating weight.

Also, the power generator in the present invention comprises a resilient member to which deformation forces are applied, rotating means undergoing rotary motion due to restoring forces developed by the resilient member restoring to an original shape, and a power generation element for generating electromotive forces with the rotary motion of the rotating means.

Also, the power generator in the present invention comprises a piezoelectric device for generating electromotive forces with the piezoelectric effect when subjected to a displacement.

Also, the mode shift control device in the present invention shifts the operating mode of the driven device to the power saving mode when the electronic equipment is in the not-carried state and the power generation state of the power generator is in a predetermined power generation state which is set beforehand and corresponds to the power saving mode.

Further, the carried-by-user detector in the present invention includes an acceleration sensor for detecting acceleration generated when the electronic equipment is carried by the user.

Also, the carried-by-user detector in the present invention detects the carried state of the electronic equipment by detecting a change in electrode-to-electrode resistance value or electrode-to-electrode capacitance value occurring when the electronic equipment is carried by the user.

Also, the carried-by-user detector in the present invention includes a switch portion turning into an on- or off-state when the electronic equipment is carried by the user, and detects the carried state of the electronic equipment in accordance with the on/off state of the switch portion.

In addition, the present invention includes a control method for electronic equipment comprising a power supply device capable of accumulating electric energy, and a driven device driven with electric power supplied from the power supply device, the control method comprising a carried-by-user detecting step of detecting whether the electronic equipment is in a state carried by a user or not, and a mode shift control step of shifting an operating mode of the driven device from a normal operating mode to a power saving mode in accordance with a result of the detection when the electronic equipment is in a state not carried by the user, for thereby reducing power consumption of the driven device.

Further, the power supply device in the present invention includes a power generator for generating electric power by converting first energy into the electric energy as second energy, and the carried-by-user detecting step is detects whether the electronic equipment is in the state carried by the user or not in accordance with a power generation state of the power generator.

Also, the present invention further comprises an operating condition restoring step of, when the operating mode is restored to the normal mode again after a shift to the power saving mode, restoring an operating condition of the driven device to the same operating condition which would have resulted in the case of operating the driven device continuously for a period of time from the shift to the power saving mode to the time of restoring to the normal mode.

Also, the mode shift control step in the present invention shifts the operating mode to the power saving mode before an amount of power accumulated in the power supply device becomes less than a predetermined amount of power which is set beforehand and corresponds to the amount of power required for the restoring of the operating condition.

Also, the driven device in the present invention is a time indicating device for indicating the time with the electric power supplied from the power supply device, and the normal operating mode is an indication mode causing the time indicating device to indicate the time.

Also, the first energy in the present invention is any of kinetic energy, pressure energy or thermal energy.

Also, the first energy in the present invention is optical energy, and the mode shift control step includes the carried-by-user detecting step of detecting whether the electronic equipment is in the state carried by the user or not, and shifting the operating mode of the driven device to the power saving mode when the electronic equipment is in the not-carried state and the power generation state of the power generator is in a predetermined power generation state which is set beforehand and corresponds to the power saving mode.

Also, the driven device in the present invention is a time indicating device for indicating the time with the electric power supplied from the power supply device, and the mode shift control device shifts the operating mode of the time indicating device to the power saving mode in accordance with a power generation state of the power generator, for thereby reducing power consumption of the time indicating device.

Further, the present invention further comprises a time indication restoring device for, when the operating mode is restored to a time indication mode as the normal mode again after a shift to the power saving mode, restoring a time indicative condition of the time indicating device to the same time indicative condition which would have resulted in the case of operating the time indicating device continuously for a period of time from the shift to the power saving mode to the time of restoring to the time indication mode.

Also, the power saving mode in the present invention stops the time indication in the time indicating device.

Also, the time indicating device in the present invention comprises an hour- and minute-hand driving device for driving hour and minute hands, and a second hand driving device for driving a second hand, and the power saving mode comprises a first power saving mode in which operation of the second hand driving device is stopped, and a second power saving mode in which operations of the hour- and minute-hand driving device and the second hand driving device are stopped.

Also, the time indicating device in the present invention is an analog indicating device for mechanically driving analog hands to rotate the hands, and the mode shift control device comprises a power-saving-mode time storage for storing a power-saving-mode duration time during which the power saving mode is continued, and a time restoring portion for restoring the time indication of the analog indicating device based on the power-saving-mode duration time when the operating mode is shifted from the power saving mode to the indiction mode.

Also, the mode shift control device in the present invention has a mode setting function capable of selectively setting one of the power saving modes in which the time indication of the time indicating device is stopped in accordance with the power generation state of the power generator, and the indication mode in which the time is indicated.

Moreover, the present invention includes a control method for electronic equipment comprising a power supply device capable of accumulating electric energy, and a time indicating device capable of indicating the time with electric power supplied from the power supply device, the control method comprising a carried-by-user detecting step of detecting whether the electronic equipment is in a state carried by a user or not, and a mode shift control step of shifting an operating mode of the driven device from a normal operating mode to a power saving mode in accordance with a detection result in the carried-by-user detecting step when the electronic equipment is in a state not carried with the user, for thereby reducing power consumption of the driven device.

Further, the power supply device in the present invention includes a power generator for generating electric power by converting first energy into the electric energy as second energy, and the carried-by-user detecting step detects whether the electronic equipment is in the state carried with the user or not in accordance with a power generation state of the power generator.

Also, the present invention further comprises a time indication restoring step of, when the operating mode is restored to the normal mode again after a shift to the power saving mode, restoring a time indicative condition of the time indicating device to the same time indicative condition as would have resulted in the case of operating the time indicating device continuously for a period of time from the shift to the power saving mode to the time of restoring to the normal mode.

Also, the mode shift control step in the present invention shifts the operating mode to the power saving mode before an amount of power accumulated in the power supply device becomes less than a predetermined amount of power which is set beforehand and corresponds to the amount of power required for the restoring of the operating condition.

Also, the mode shift control step in the present invention includes a power-generation-state determining step of determining whether the power generator is in a state of generating power or not based on whether an electromotive voltage of the power generator is higher than a setting voltage set beforehand, and shifting the operating mode from the power saving mode to an indication mode, in which the time is indicated, in accordance with a result of the determination when the power generator is brought into the state of generating power.

Also, the mode shift control step in the present invention includes a power-generation-state determining step of determining whether the power generator is in a state of generating power or not based on whether a power generation duration time of the power generator is longer than a setting time set beforehand, and shifts the operating mode from the power saving mode to an indication mode, in which the time is indicated, in accordance with a result of the determination when the power generator is brought into the state of generating power.

Also, the power saving mode in the present invention stops the time indication in the time indicating device.

Also, the time indicating device in the present invention comprises an hour- and minute-hand driving device for driving hour and minute hands, and a second hand driving device for driving a second hand, and the power saving mode comprises a first power saving mode in which operation of the second hand driving device is stopped, and a second power saving mode in which operations of the hour- and minute-hand driving device and the second hand driving device are stopped.

According to any of the above-described features of the present invention, when the electronic equipment is not carried by the user, or when the electronic is not carried by the user and the power generator is in the state of not generating power, the operating mode is shifted to the power saving mode. The electronic equipment (timepiece) is provided which can save energy without inconveniencing the user.

BRIEF DESCRIPTION OF THE DRAWINGS

FIG. 3 is a flowchart showing a summary of a mode changing process in the timepiece shown in FIG. 1.

FIG. 10 is a flowchart showing a summary of a mode setting step in the timepiece according to the second embodiment.

DETAILED DESCRIPTION

The present invention will be described below in more detail with reference to the drawings.

[1] First Embodiment

[1.1] Construction of Timepiece

Figure 1:
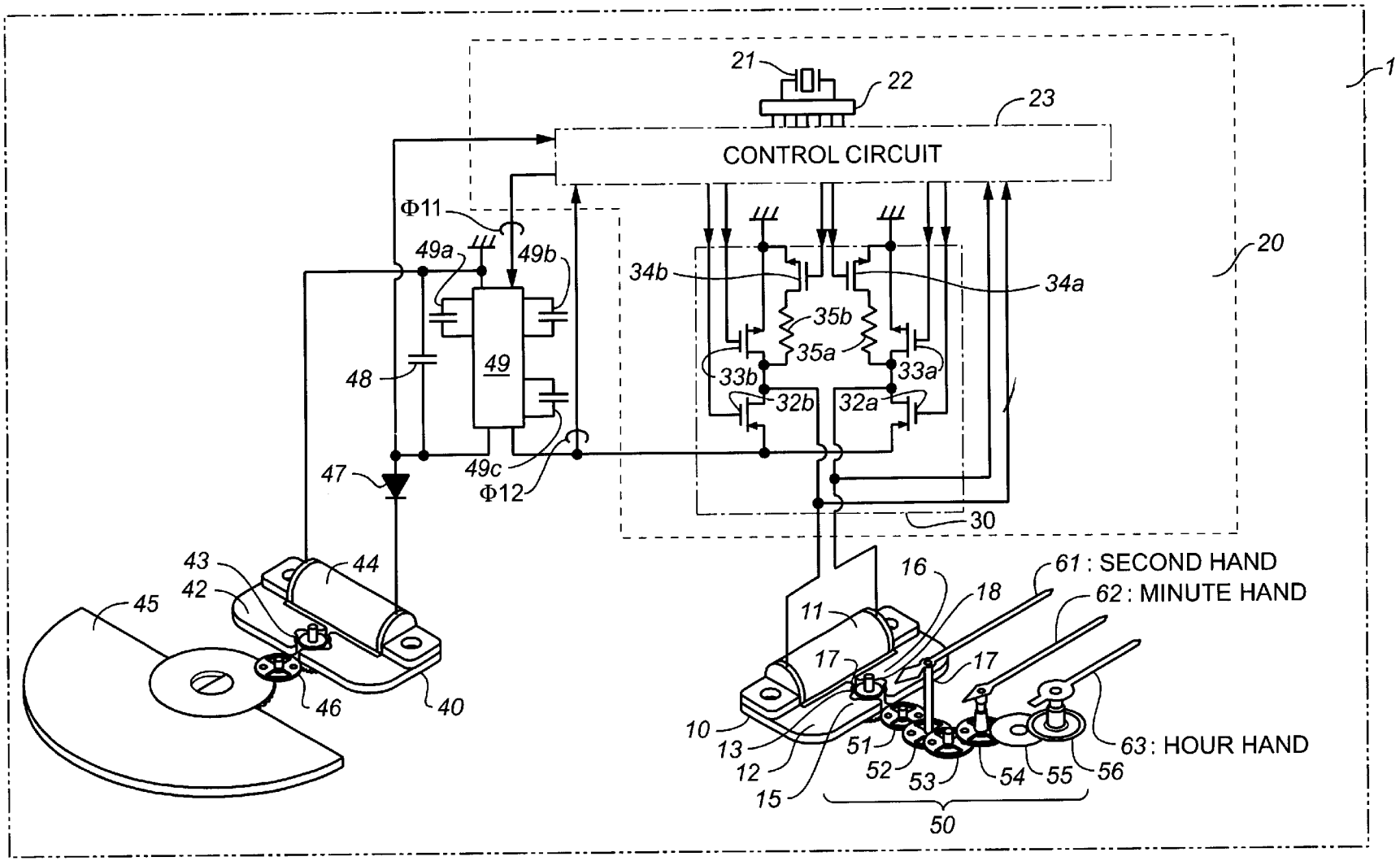
FIG. 1 is a schematic diagram showing a construction of a timepiece according to a first embodiment and containing a motor and a power generator.

FIG. 1 schematically shows a construction of a timepiece 1 as one form of electronic equipment according to the first embodiment of the present invention.

In the timepiece 1 of the first embodiment, a stepping motor 10 is driven by a control device 20 to stepwisely rotate a second hand 61, a minute hand 62, and an hour hand 63 through a wheel train 50. Electric power for driving the stepping motor 10, the control device 20, etc. is produced by a power generator 40.

The power generator 40 for the timepiece 1 comprises an AC power generator of electromagnetic induction type wherein a power generating rotor 43 is rotated within a power generating stator 42 to induce electric power in a power generating coil 44 connected to the power generating stator 42, the induced power being outputted to the outside. Further, in the timepiece 1 of this embodiment, a rotating weight 45 is employed as a means for transmitting kinetic energy to the power generating rotor 43, and motion of the rotating weight 45 is transmitted to the power generating rotor 43 through a speed-up gear 46. In the case of the timepiece 1 being of wristwatch type, the rotating weight 45 swings in the timepiece 1 with movement of the user's arm, for example. Thus, electric power can be generated by utilizing energy in the natural environment of the user, and the timepiece 1 can be driven with the generated power.

The power outputted from the power generator 40 is subjected to half-wave rectification by a diode 47, and thereafter once accumulated in a large-capacity capacitor 48 which serves as a power supply device. Then, driving power for driving the stepping motor 10 is supplied from the large-capacity capacitor 48 to a driving circuit 30 in the control device 20 through a voltage stepping-up and -down circuit 49. The voltage stepping-up and -down circuit 49 in this embodiment comprises a plurality of capacitors 49*a*, 49*b* and 49*c* for increasing or reducing a voltage in multiple steps. The voltage supplied to the driving circuit 30 can be adjusted by a control signal ϕ11 from a control circuit 23 in the control device 20. Also, the output voltage of the voltage stepping-up and -down circuit 49 is supplied to the control circuit 23 through a monitoring circuit ϕ12. With such a circuit arrangement, the output voltage can be monitored, and the control device 20 can determine whether the power generator 40 is generating power or not based on a small increase or decrease of the output voltage.

The stepping motor 10 used in the timepiece 1 of this first embodiment is a motor driven with a pulse signal. Such a motor is called a pulse motor, a stepping motor, a step-rotating motor or a digital motor, and is employed as an actuator for a digital control device in many cases. Recently, stepping motors having smaller size and weight have been employed as actuators for many electronic devices or information equipment which are small in size and are suitable for being carried by users. Typical examples of these electronic devices are timepieces such as electronic watches, time switches, and chronographs. The stepping motor 10 in this embodiment is of PM type (permanent magnet rotating type) comprising a driving coil 11 for generating magnetic forces with driving pulses supplied from the control device 20, a stator 12 excited by the driving coil 11, and a rotor 13 rotating under a magnetic field produced within the stator 12, the rotor 13 being constructed of a disk-shaped double-pole permanent magnet. Magnetic saturation portions 17 are provided in the stator 12 so that the magnetic forces generated by the driving coil 11 produce different magnetic poles in respective phases (poles) 15 and 16 around the rotor 13. Also, for restricting the direction of rotation of the rotor 13, an inner notch 18 is formed in an appropriate position along an inner periphery of the stator 12 to generate cogging torque, thereby stopping the rotor 13 in an appropriate position.

The rotation of the rotor 13 of the stepping motor 10 is transmitted to respective hands by a wheel train 50 which comprises a 5th wheel 51 meshing with the rotor 13 through a pinion, a 4th (secondhand) wheel 52, a 3rd wheel 53, a 2nd (center) wheel 54, a minute wheel 55 and an hour wheel 56. A second hand 61 is connected to a shaft of the 4th wheel 52, a minute hand 62 is connected to a shaft of the 2nd wheel 54, and an hour hand 63 is connected to a shaft of the hour wheel 56. With the rotation of the rotor 13, those hands are rotated to indicate the time. Of course, a transmission system (not shown) for indicating a date, etc. can also be connected to the wheel train 50.

In the timepiece 1, to indicate the time with the rotation of the stepping motor 10, driving pulses are supplied to the stepping motor 10 while counting (clocking) a signal having a reference frequency. The control device 20 for controlling the stepping motor 10 in this embodiment comprises a pulse synthesis circuit 22 for generating reference pulses of the reference frequency and pulse signals different in pulse width and timing by using a reference oscillation source 21 such as a quartz oscillator, and a control circuit 23 for controlling the stepping motor 10 in accordance with the various pulse signals supplied from the pulse synthesis circuit 22. Though described later in detail, the control circuit 23 controls the driving circuit and detects the rotation, and is designed to be able to output pulses such as driving pulses supplied to the driving coil 11 through the driving circuit for driving the driving rotor 13 of the stepping motor 10, rotation detecting pulses supplied subsequent to the driving pulses to induce an induction voltage for detecting the rotation of the driving rotor 13, auxiliary pulses having large effective power to forcibly rotate the driving rotor 13 when it is not rotated, and demagnetizing pulses having different magnetic poles and supplied subsequent to the auxiliary pulses for demagnetization.

The driving circuit 30 for supplying various driving pulses to the stepping motor 10 under control of the control circuit 23 comprises a bridge circuit made up of a p-channel MOS transistor 33*a* and an n-channel MOS transistor 32*a* which are connected in series, a p-channel MOS transistor 33*b*, and an n-channel MOS transistor 32*b*. This circuit arrangement makes it possible to control the power supplied to the stepping motor 10 from the large-capacity capacitor 48, as the power supply device, and the voltage stepping-up and -down circuit 49. The driving circuit 30 further comprises rotation detecting resistors 35*a* and 35*b* connected respectively to the p-channel MOS transistors 33*a* and 33*b* in parallel, and p-channel MOS transistors 34*a* and 34*b* for supplying chopper pulses to the resistors 35*a* and 35*b* for the purpose of sampling. By applying control pulses, which are different in polarity and pulse width, at the respective timings from the control circuit 23 to gate electrodes of these MOS transistors 32*a*, 32*b*, 33*a*, 33*b*, 34*a* and 34*b*, therefore, the driving pulses having different polarities can be supplied to the driving coil 11, or the detecting pulses for detecting the rotation of the rotor 13 and for exciting the induced voltage to detect a magnetic field can be supplied.

[1.2] Functional Construction of Timepiece of First Embodiment

Figure 2:
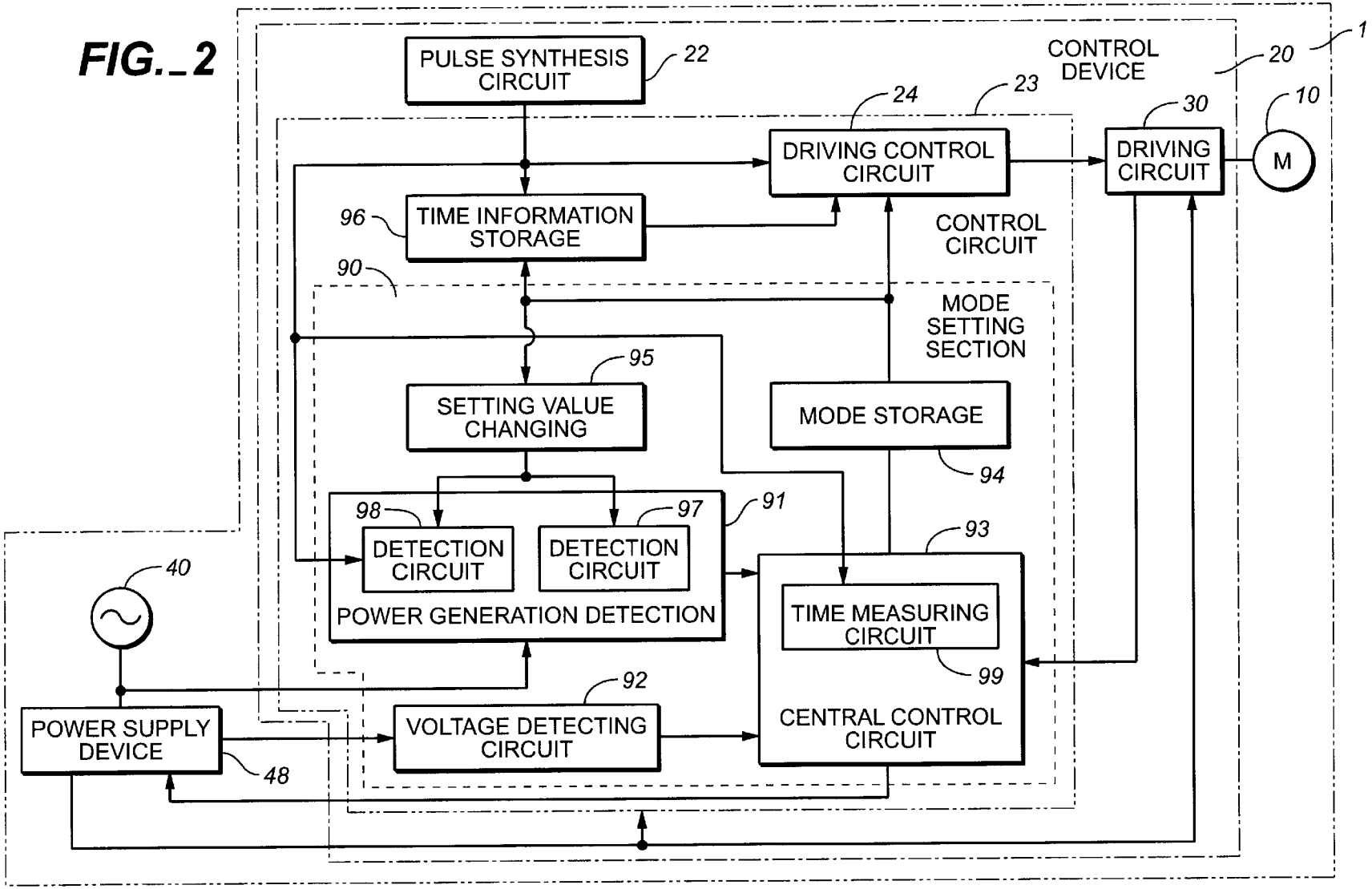
FIG. 2 shows, in the form of a schematic block diagram, a construction of the timepiece shown in FIG. 1.

FIG. 2 shows, in the form of a functional schematic block diagram, a construction of the timepiece 1 of the first embodiment.

In the timepiece 1 of this embodiment, as described above, a reference signal produced by the pulse synthesis circuit 22 is supplied to a driving control circuit 24, and the driving circuit 30 is operated under control of the driving control circuit 24 to drive the stepping motor 10 for rotating the hands in a stepwise manner.

Power is supplied to the control circuit 23 and the driving circuit 30 from the power supply device 48, and the power supply device 48 is charged with the power generated by the power generator 40. A voltage (electromotive voltage) Vgen on the output side of the power generator 40 is supplied to a power generation detecting circuit 91 in a mode setting section 90 of the control circuit 23, and the power generation detecting circuit 91 is able to determine whether power is generated by the power generator 40. The power generation detecting circuit 91 in this embodiment comprises a first detecting circuit 97 for comparing the electromotive voltage Vgen with a setting value Vo and then determining whether power generation is detected, and a second detecting circuit 98 for comparing power generation duration time Tgen, during which the electromotive voltage Vgen not lower than a voltage Vbas fairly smaller than the setting value Vo is obtained, with a setting value To and then determining whether power generation is detected. If any one of the conditions determined by the first and second detecting circuits 97 and 98 is satisfied, the power generation detecting circuit 91 determines that power generation is detected.

The mode setting section 90 further includes a voltage detecting circuit 92 capable of comparing an output voltage Vout of the large-capacity capacitor 48 as the power supply device with a setting value, and then determining a charged state of the large-capacity capacitor 48. Determination results from the power generation detecting circuit 91 and the voltage detecting circuit 92 are supplied to a central control circuit 93 having functions to control the mode setting section 90 and other components of the control circuit 23 for selectively setting one of a power saving mode to reduce power consumption and an indication mode to perform normal indication of the time.

In this connection, the power saving mode means an operating mode in which the driving of the stepping motor 10 is stopped and the stepwise rotation of the hands is stopped. In such a condition, however, the reference oscillation source 21, the pulse synthesis circuit 22, the voltage detecting circuit 92, the mode setting section 90, etc. are kept in an operative state so that the operating mode can be switched over.

The central control circuit 93 includes a non-power-generation time measuring circuit 99 for measuring a non-power-generation time Tn during which power generation is not detected by the first and second detecting circuits 97 and 98. When the non-power-generation time Tn exceeds a predetermined setting time, the operating mode shifts from the indication mode to the power saving mode. The set operating mode is stored in a mode storage 94, and the stored information is supplied to the driving control circuit 24, a time information storage 96, and a setting value changing portion 95. Upon the shift from the indication mode to the power saving mode, the driving control circuit 24 stops supply of the pulse signal to the driving circuit 30, thereby stopping the driving circuit 30. Accordingly, the motor 10 ceases rotation and the time indication is stopped.

Also, upon the shift from the indication mode to the power saving mode, the time information storage 96 starts operation as a suspension time counter which receives the reference signal produced by the pulse synthesis circuit 22 and stores a duration time of the power saving mode. Then, upon the shift from the power saving mode to the indication mode, the time information storage 96 effects another function of counting fast-forward pulses supplied from the driving control circuit 24 to the driving circuit 30 and causing the resumed time indication to be restored to the current time.

The setting value changing portion 95 changes magnitudes of the setting values Vo and To of the first and second detecting circuits 97 and 98 in the power generation detecting circuit 91 upon the shift from the power saving mode to the indication mode. In this embodiment, setting values Va and Ta in the indication mode are set to be lower than setting values Vb and Th in the power saving mode. In the indication mode, therefore, the accuracy in detecting the power generation state is set to be higher (i.e., more sensitive or distinct). Thus, even with the voltage being low or the power generation duration time being short, if a power generation output is obtained, it is determined that power generation is detected, and the indication mode is maintained. On the other hand, in the power saving condition, the accuracy in detecting the power generation state is set to be lower (i.e., more insensitive or indistinct). Thus, when the relatively high electromotive voltage is obtained, or when the relatively long power generation duration time is obtained, it is determined that power generation is detected. Further, if the condition is satisfied that the charged voltage is sufficient, the operating mode shifts to the indication mode.

Since the system supply voltage varies depending on the charged state, it is desired to generate the setting voltage used for comparison and determination of the electromotive voltage Vgen, etc. by using a constant-voltage circuit which generates a stable voltage. Also, it is possible to employ, as a threshold (setting value), a voltage having a fixed difference with respect to the varying system source voltage. The fixed difference value can be determined, for example, by using a threshold Vth of a MOSFET which does not depend on the power supply voltage.

[1.3] Mode Setting Steps

FIG. 3 shows, in the form of a flowchart, a summary of mode setting steps for carrying out a mode changing process in the timepiece of this embodiment.

First, the current operating mode is determined in step 71.

If the current operating mode is the power saving mode, counting of the suspension time is continued by the time information storage 96 in step 74. Then, the setting values Vo and To in the power generation detecting circuit 91 are set to the values Vb and Tb for the power saving mode in step 75. On the other hand, if the current operating mode is the indication mode, the driving control circuit 24 controls the driving circuit 30 to produce the driving pulses and effects the time indication in step 72. Then, the setting values Vo and To in the power generation detecting circuit 91 are set to the values Va and Ta for the indication mode in step 73.

Next, a power generation level (electromotive voltage) is detected in step 76.

If it is determined in step 76 that the electromotive voltage is produced even though its level is small, the power generation duration time Tgen is counted up in step 77.

Then, the power generation duration time Tgen is compared with the setting time To in step 78. If the power generation duration time Tgen is not less than the setting time To, processing goes to step 80 upon a decision that power generation is detected.

If it is determined in step 78 that the power generation duration time Tgen does not reach the setting time To, the electromotive voltage Vgen is compared with the setting value Vo in step 79. If the electromotive voltage Vgen reaches the setting value Vo, processing goes to step 80 upon a decision that power generation is detected.

In step 80, the mode is determined again. If the mode is not the power saving mode, the non-power-generation time Tn is cleared in step 81, following which processing returns to step 71 and continues the time indication in step 72.

Conversely, if the mode is the power saving mode, the voltage Vout of the power supply device 48 is determined in step 82. If the power supply device 48 is sufficiently charged, the mode is shifted from the power saving mode to the indication mode and the power saving mode is cleared in step 83.

If the power supply device 48 is not sufficiently charged as a result of determining the voltage Vout of the power supply device 48 in step 82, processing returns to step 71 again while the power saving mode is maintained, followed by repeating the process described above.

When the time is indicated again upon the shift to the indication mode, the time indication is fast forwarded in accordance with the suspension time counted by the time information storage 96, and normal rotation of the hands per second is started after restoring to the current time. As a result, the user can view the precise time indicated after returning to the indication mode.

On the other hand, if the electromotive voltage is not detected in step 76, or if the power generation duration time Tgen does not reach the setting time To and the electromotive voltage Vgen also does not reach the setting value Vo, processing goes to step 85 upon a decision that power generation is not detected, where the mode at that time is determined. In this respect, when the electromotive voltage is not detected in step 76, the power generation duration time Tgen is cleared in step 84.

If the mode is determined to be the power saving mode in step 85, processing returns to step 71 directly to continue counting-up of the suspension time.

If the mode is determined to be the indication mode, the non-power-generation time Tn is counted up in step 86, and whether a predetermined non-power-generation time is continued or not is determined in step 87. If the non-power-generation time Tn has elapsed, the mode is shifted from the indication mode to the power saving mode in step 88, thereby starting the power saving. In step 88, the operations of both the driving control circuit 24 and the driving circuit 30 are stopped to nullify power consumption of the motor 10, and counting of the suspension time is started by the time information storage 96.

Thus, in the timepiece 1 of this embodiment, the time indication is stopped or resumed depending on whether power is generated or not. As described above, the power generator 40 in this embodiment is such a system that power is generated by motion of the user's arm or vibration with the aid of the rotating weight 45. Accordingly, the fact that power generation is detected means that the timepiece is fitted on the user's arm, or that the user carries the timepiece while putting it in a pocket or the like. In view of the above, when power generation is detected, the mode is shifted to the indication mode in which the time is indicated, upon a decision that the timepiece is carried by the user. Conversely, when power generation is not detected, the mode is shifted to the power saving mode in which the time is not indicated, upon a decision that the timepiece is not carried by the user. As a result, the energy accumulated in the large-capacity capacitor 48 can be saved.

Further, in the timepiece 1 of the first embodiment, it is determined that power generation is detected, when the predetermined electromotive voltage Vgen is detected, and when power generation is continued for the predetermined time. Therefore, even when the mode is shifted to the power saving mode in a condition of the timepiece not being carried by the user and power generation is then accidentally induced for some reason, e.g., vibration, the mode is kept from shifting to the indication mode if the electromotive voltage is weak and the duration time is short. Useless consumption of energy can be thus prevented. On the other hand, in the indication mode, since the setting value Vo is set to be lower than in the power saving mode, it is determined that power generation is detected if the electromotive voltage is obtained even though the detected electromotive voltage Vgen is somewhat low. As a result, the time indication is continued so long as power is generated even at a low level. Also, in the indication mode, since the setting time To for the power generation duration time Tgen is also set to be shorter, the time indication is maintained so long as power is generated even for a short time.

Moreover, in the timepiece 1 of the first embodiment, the non-power-generation time Tn is measured, and the mode is not shifted to the power saving mode unless the non-power-generation time reaches the setting time. Accordingly, it is possible to maintain the time indication not only in the case where motion of the user is stopped and power is not generated for a short time, but also in the case where the user takes off the wristwatch for a period of time such as during a meeting. Also, the time may be continuously indicated even when the user takes off the wristwatch all night. As an alternative, for the purpose of saving energy, the mode may be shifted to the power saving mode if the user takes off the wristwatch for a period of about five minutes.

[1.4] Advantages of First Embodiment

With the timepiece 1 of this embodiment, as described above, whether the timepiece is carried by the user or not can be automatically determined based on the power generation state. Then, the timepiece can sufficiently function as a wristwatch or the like by indicating the time when carried by the user, and can reduce consumption of energy without indicating the time when not carried by the user.

More specifically, when the hands are fast forwarded with shortened intervals of hand rotation for restoring the time indication to the current time, power consumption is increased in comparison with that in the indication mode (i.e., the normal operating mode).

However, when the above-described analog watch is used as the timepiece 1 and is operated with a 12-hour indication scheme, the hands take the same position each period of 12 hours. Accordingly, as the elapsed time in the power saving mode is prolonged, the power saving effect is increased and energy consumption can be reduced more effectively. This is equally applied to the case where the timepiece is operated with a 24-hour indication scheme and repeats the same indication state at a period of 24 hours.

To describe in more detail, assuming, for example, that power of about X [W] is consumed when the hands are driven in the indication mode for 12 hours, the power required for driving the hands for 108 hours (12×9 hours) is about (X×9) [W].

By contrast, assuming, for example, that power of about Y (>X) [W] is consumed when the timepiece is left standing in the power saving mode for 12 hours and then restored to the current time, the power required for restoring the hands to the current time after being left standing for 108 hours is also Y [W]. Thus, the longer a period of time during which the timepiece is left standing in the power saving mode, the higher is the power saving effect.

Accordingly, the power once charged in the large-capacity capacitor can be effectively utilized. Even with the timepiece left standing for a long time, the time is not indicated and only the elapsed time is measured during such a period of time. When the user wears the timepiece again, the time indication is resumed and restored to the current time, thereby indicating the precise time. With no need of employing a capacitor being so large in capacity, therefore, a small size wristwatch or the like capable of keeping time for a long time with good accuracy can be realized by incorporating, in place of a battery, a power generator and a capacitor having an appropriate capacity. Also, since the capacity of a capacitor is not required to be so large, a timepiece can be realized which has a good start-up characteristic, and can resume the indication and restore to the current time as soon as power generation is started. In addition, with the timepiece of this embodiment, the user can always see the time regardless of surrounding conditions even in a dark place, for example, when carried by the user, and therefore the user is completely free from inconvenience.

[1.5] Modifications of First Embodiment

[1.5.1] First Modification

While the above description has been made in connection with, by way of example, the timepiece indicating the time with the motor 10, the present invention is of course also applicable to another type of timepiece indicating the time with an LCD (Liquid Crystal Device), etc. In this modification, the time can be continuously counted for a long time while saving power consumed by the LCD, and the precise current time can be always displayed as required.

[1.5.2] Second Modification

Further, the above description has been made as employing the power generation detecting circuit 91 which includes both the first detecting circuit 97 for comparing the electromotive voltage Vgen with the setting value Vo and then determining whether power generation is detected, and the second detecting circuit 98 for comparing the power generation duration time Tgen, during which the electromotive voltage Vgen not lower than the voltage Vbas fairly smaller than the setting value Vo is obtained, with the setting value To and then determining whether power generation is detected. However, whether power is generated or not can be of course also determined by using one of the first and second detecting circuits 97 and 98.

By providing the second detecting circuit 98, in particular, whether the user wears the timepiece or not can be determined with higher reliability.

[1.5.3] Third Modification

In the above description, as shown in FIG. 3, when the mode is in the indication mode, whether the predetermined non-power-generation time is continued or not is determined in step 87. If the counted non-power-generation time Tn has elapsed, the mode is shifted from the indication mode to the power saving mode, thereby starting the power saving. By contrast, in this third modification, the shift to the power saving mode is allowed only when the voltage of the large-capacity capacitor 48 as the power supply device is not less than a voltage sufficient for restoring the indication of the current time at the time of the shift from the power saving mode to the indication mode.

More specifically, even if the counted non-power-generation time Tn exceeds the predetermined non-power-generation time, it is determined whether the voltage of the large-capacity capacitor 48 is not less than the voltage sufficient for restoring the time indication (high-speed hand rotation to the current time) at the time of return to the indication mode. Then, the mode is shifted to the power saving mode if the capacitor voltage is not less than the voltage sufficient for restoring the indication of the current time at the time of return to the indication mode.

On the other hand, if the voltage of the large-capacity capacitor 48 is less than the voltage sufficient for restoring the indication of the current time at the time of return to the indication mode, the time indication, i.e., the indication mode, is continued in an indication mode to prompt the user to charge the capacitor.

In this case, the indication mode for prompting the user to charge the capacitor is realized by setting intervals of hand rotation to two seconds, for example, when intervals of second-hand rotation are set to one second under normal hand driving.

As a result of the above construction, the user can easily understand that charging is not sufficient, and can forcibly charge the capacitor by forcibly shaking the timepiece.

[1.5.4] Fourth Modification

In the above description, as shown in FIG. 3, the voltage Vout of the power supply device 48 is determined in step 82, and if the capacitor is not sufficiently charged, the power saving mode is maintained. By contrast, in this fourth modification, when the power supply device 48 is not sufficiently charged and the voltage Vout of the power supply device 48 is a voltage that is insufficient for restoring the indication of the current time, but sufficient for performing the normal hand driving, the normal hand driving is resumed without restoring the indication of the current time.

As a result, because the normal hand driving is started, but the indication of the current time is not restored, the user can easily understand that charging is not sufficient, and can forcibly charge the capacitor by forcibly shaking the timepiece.

[2] Second Embodiment

Next, a second embodiment according to the present invention will be described with reference to the drawings.

[2.1] Entire Construction

Figure 4:
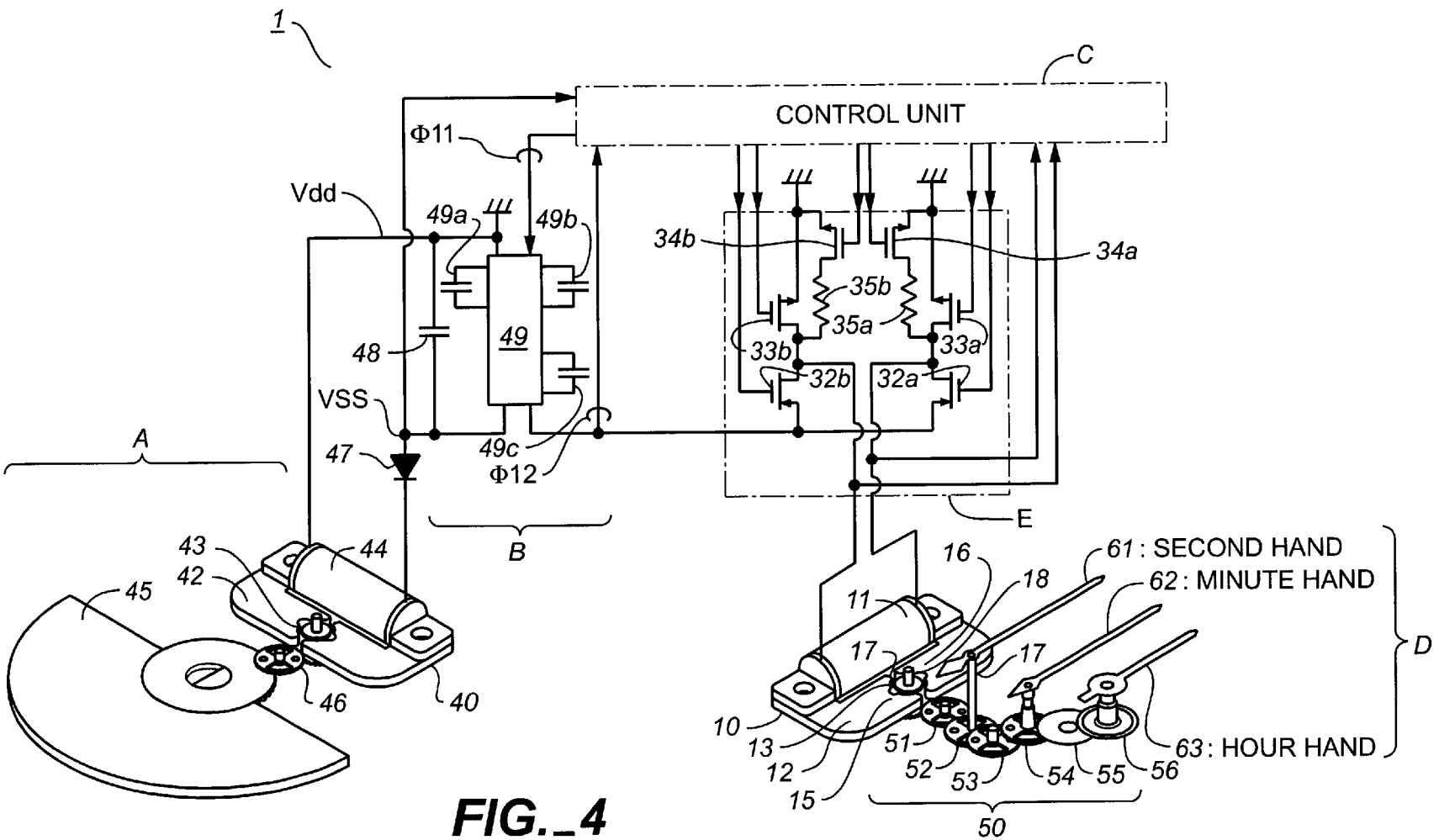
FIG. 4 is a schematic diagram showing a construction of a timepiece according to a second embodiment.

FIG. 4 shows a schematic construction of a timepiece 1 according to the second embodiment. In FIG. 4, similar components to those in the first embodiment of FIG. 1 are denoted by the same numerals.

The timepiece 1 is a wristwatch, and when used, the user winds around the wrist a band coupled to a timepiece body. The timepiece 1 of this embodiment mainly comprises a power generation unit A for generating AC power, a power supply unit B for rectifying an AC voltage from the power generation unit A, accumulating the stepped-up voltage and supplying power to the associated components, a control unit C for detecting a power generation state of the power generation unit A (in a power-generation-state detecting portion 91 described later) and controlling the entirety of the timepiece in accordance with a detection result, a hand rotating mechanism D for rotating hands stepwise by using a stepping motor 10, and a driving unit E for driving the hand operating mechanism D in accordance with a control signal from the control unit C. The control unit C switches over an operating mode depending on the power generation state of the power generation unit A between an indication mode in which the hand operating mechanism D is driven to indicate the time, and a power saving mode in which supply of power to the hand rotating mechanism D is stopped for saving of power. Also, the shift from the power saving mode to the indication mode is forcibly made by the user holding the timepiece 1 in the hand and shaking it.

Those units will be described one by one below, but the control unit C will be described last with reference to a functional block diagram.

[2.1.1] Power Generation Unit

The power generation unit A will be first described.

The power generation unit A comprises a power generator 40, a rotating weight 45 and a speed-up gear 46.

The power generator 40 comprises an AC power generator of electromagnetic induction type wherein a power generating rotor 43 is rotated within a power generating stator 42 to induce electric power in a power generating coil 44 connected to the power generating stator 42, the induced power being outputted to the outside. Also, the rotating weight 45 functions as a means for transmitting kinetic energy to the power generating rotor 43. Then, motion of the rotating weight 45 is transmitted to the power generating rotor 43 through the speed-up gear 46. In the case of the timepiece 1 being of wristwatch type, the rotating weight 45 swings in the timepiece 1 with movement of the user's arm, for example,. Thus, electric power can be generated by utilizing energy in the natural environment of the user, and the timepiece 1 can be driven with the generated power.

[2.1.2] Power Supply Unit

Next, the power supply unit B will be described.

The power supply unit B comprises a diode 47 acting as a rectifying circuit, a large-capacity capacitor 48, and a voltage stepping-up and -down circuit 49. The voltage stepping-up and -down circuit 49 comprises a plurality of capacitors 49*a*, 49*b* and 49*c* for increasing and reducing a voltage in multiple steps. The voltage supplied to the driving unit E can be adjusted by a control signal ϕ11 from the control unit C. Also, the output voltage of the voltage stepping-up and -down circuit 49 is supplied to the control unit C with a monitoring signal ϕ12 so that the output voltage can be monitored. Here, the power supply unit B takes Vdd (higher voltage side) as a reference potential (GND), and produces Vss (lower voltage side) as a supply source voltage.

[2.1.3] Hand Rotating Mechanism

Next, the hand rotating mechanism D will be described.

The stepping motor 10 used in the hand rotating mechanism D is a motor driven with a pulse signal. Such a motor is called a pulse motor, a stepping motor, a step-rotating motor or a digital motor, and is employed as an actuator for a digital control device in many cases. Recently, stepping motors having smaller size and weight have been employed as actuators for many electronic devices or information equipment which are small in size and are suitable for being carried by users. Typical examples of these electronic devices are timepieces such as electronic watches, time switches, and chronographs.

[2.1.3.1] Stepping Motor

The stepping motor 10 in this second embodiment comprises a driving coil 11 for generating magnetic forces with driving pulses supplied from the driving unit E, a stator 12 excited by the driving coil 11, and a rotor 13 rotating under a magnetic field produced within the stator 12. Also, the stepping motor 10 is of PM type (permanent magnet rotating type) wherein the rotor 13 is constructed of a disk-shaped double-pole permanent magnet. Magnetic saturation portions 17 are provided in the stator 12 so that the magnetic forces generated by the driving coil 11 produce different magnetic poles in respective phases (poles) 15 and 16 around the rotor 13. Further, for restricting the direction of rotation of the rotor 13, an inner notch 18 is formed in an appropriate position along an inner periphery of the stator 12 to generate cogging torque, thereby stopping the rotor 13 in an appropriate position.

The rotation of the rotor 13 of the stepping motor 10 is transmitted to respective hands by a wheel train 50 which comprises a 5th wheel 51 meshing with the rotor 13 through a pinion, a 4th (secondhand) wheel 52, a 3rd wheel 53, a 2nd (center) wheel 54, a minute wheel 55 and an hour wheel 56. A second hand 61 is connected to a shaft of the 4th wheel 52, a minute hand 62 is connected to a shaft of the 2nd wheel 54, and an hour hand 63 is connected to a shaft of the hour wheel 56. With the rotation of the rotor 13, those hands are rotated to indicate the time. Of course, a transmission system (not shown) for indicating a date, etc. can also be connected to the wheel train 50.

[2.1.4] Driving Unit

Next, the driving unit E supplies various driving pulses to the stepping motor 10 under control of the control unit C. The driving unit E comprises a bridge circuit made up of a p-channel MOS transistor 33*a* and an n-channel MOS transistor 32*a* which are connected in series, a p-channel MOS transistor 33*b*, and an n-channel MOS transistor 32*b*. The driving unit E further comprises rotation detecting resistors 35*a* and 35*b* connected respectively to the p-channel MOS transistors 33*a* and 33*b* in parallel, and p-channel MOS transistor 34*a* and 34*b* for supplying chopper pulses to the resistors 35*a* and 35*b* for the purpose of sampling. By applying control pulses, which are different in polarity and pulse width, at the respective timings from the control unit C to gate electrodes of those MOS transistors 32*a*, 32*b*, 33*a*, 33*b*, 34*a* and 34*b*, therefore, the driving pulses having different polarities can be supplied to the driving coil 11, or the detecting pulses for detecting the rotation of the rotor 13 and for exciting the induced voltage to detect a magnetic field can be supplied.

[2.1.5] Control Unit

Figure 5:
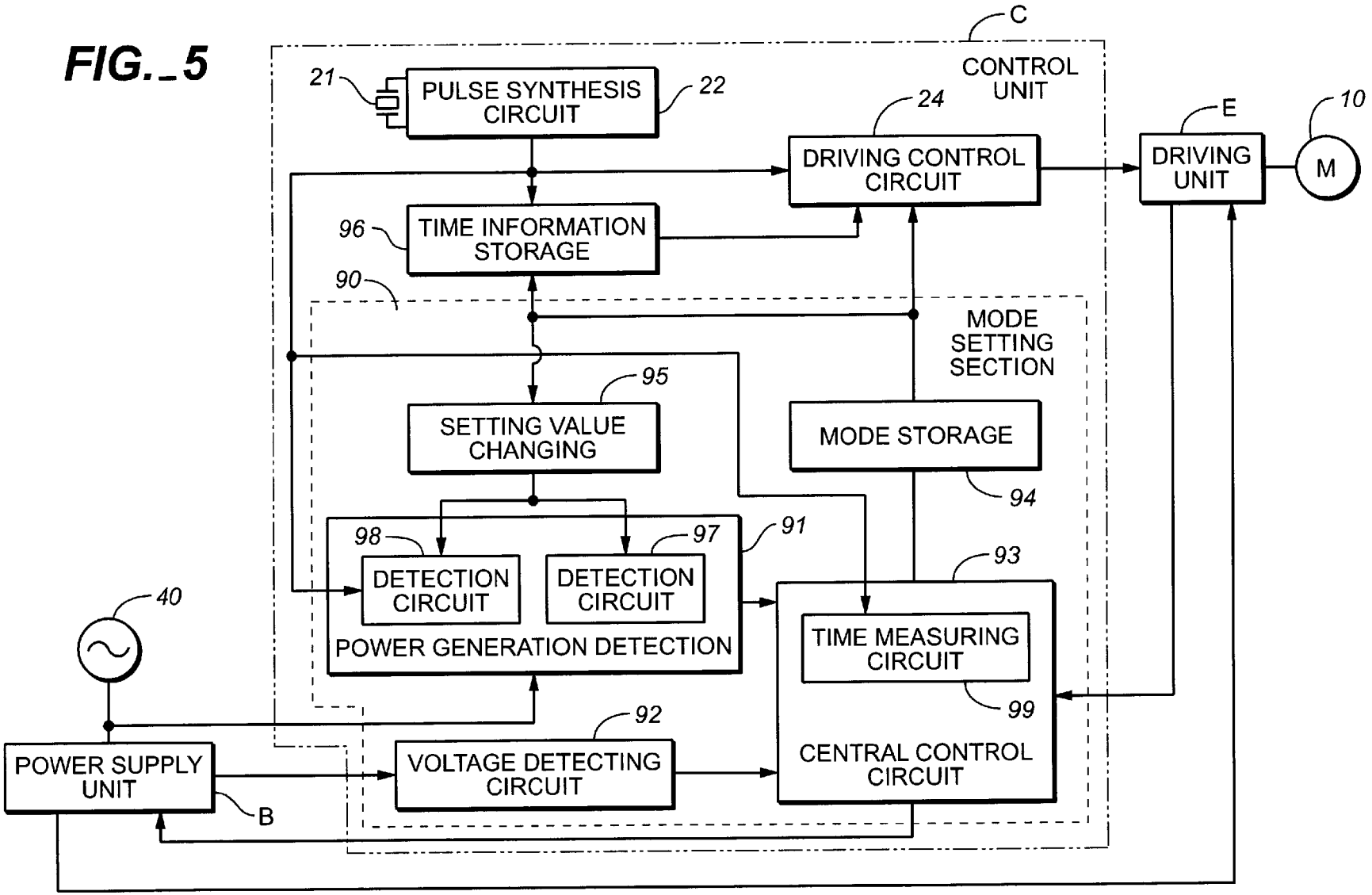
FIG. 5 is a functional block diagram showing a construction of a control unit and related components according to the second embodiment.

Next, the construction of the control unit C will be described with reference to FIG. 5. FIG. 5 is a functional block diagram of the control unit C and related components. The control unit C comprises a pulse synthesis circuit 22, a mode setting section 90, a time information storage 96, and a driving control circuit 24.

First, the pulse synthesis circuit 22 is made up of an oscillation circuit for oscillating reference pulses of stable frequency by using a reference oscillation source 21 such as a quartz oscillator, and a synthesis circuit for synthesizing frequency-divided pulses, obtained by frequency division of the reference pulse, and the reference pulse to produce various pulse signals which are different in pulse width and timing.

Then, the mode setting section 90 is made up of a power-generation-state detecting portion 91, a setting value changing portion 95 for changing setting values employed to detect the power generation state, a voltage detecting circuit 92 for detecting a charged voltage Vc of the large-capacity capacitor 48, a central control circuit 93 for controlling a time indication mode depending on the power generation state and controlling a voltage step-up factor based on the charged voltage, and a mode storage 94 for storing the mode.

The power-generation-state detecting portion 91 comprises a first detecting circuit 97 for comparing an electromotive voltage Vgen of the power generator 40 with a setting voltage value Vo and then determining whether power generation is detected, and a second detecting circuit 98 for comparing a power generation duration time Tgen, during which the electromotive voltage Vgen not lower than a setting voltage value Vbas fairly smaller than the setting voltage value Vo is obtained, with a setting time value To and then determining whether power generation is detected. If any one of the conditions determined by the first and second detecting circuits 97 and 98 is satisfied, the power-generation-state detecting portion 91 determines that power generation is detected. In this connection, the setting voltage values Vo and Vbas are each a negative voltage with Vdd (=GND) as a reference, and represents a potential difference from Vdd. Constructions of the first and second detecting circuits 97 and 98 will be described later.

Here, the setting voltage value Vo and the setting time value To can be controlled to change selectively by the setting value changing portion 95. Upon the shift from an indication mode to a power saving mode, the setting value changing portion 95 changes the magnitudes of the setting values Vo and To of the first and second detecting circuits 97 and 98 in the power generation state detecting portion 91. In this embodiment, setting values Va and Ta in the indication mode are set to be lower than setting values Vb and Tb in the power saving mode. Therefore, the shift from the power saving mode to the indication mode requires large power to be generated. A required level of the generated power is not enough at such a level as generated when the timepiece 1 is usually carried with the user, but must be such a high level as generated when the user tries to forcibly charge the capacitor by shaking their wrist. In other words, the setting values Vb and Th in the power saving mode are set to be able to detect forcible charging.

Further, the central control circuit 93 includes a non-power-generation time measuring circuit 99 for measuring a non-power-generation time Tn during which power generation is not detected by the first and second detecting circuits 97 and 98. When the non-power-generation time Tn exceeds a predetermined setting time, the operating mode shifts from the indication mode to the power saving mode. Conversely, the shift from the power saving mode to the indication mode is effected when the following conditions are satisfied; that the power generation unit A is in the state of generating power as detected by the power-generation-state detecting portion 91, and the charged voltage VC of the large-capacity capacitor 48 is sufficient.

Since the power supply unit B in this embodiment includes the voltage stepping-up and -down circuit 49, the hand rotating mechanism D can be driven by boosting the supply source voltage with the voltage stepping-up and -down circuit 49 even when the charged voltage VC is in a relatively low condition. Thus the central control circuit 93 determines the voltage step-up factor based on the charged voltage VC and controls the voltage stepping-up and -down circuit 49.

However, if the charged voltage VC is too low, the supply source voltage capable of operating the hand rotating mechanism D cannot be obtained even after being stepped up. If the mode is shifted from the power saving mode to the indication mode in such a case, the precise time indication cannot be achieved and extra power is consumed.

Taking into account the above point, in this embodiment, the charged voltage VC is compared with a setting voltage value Vc set beforehand, to thereby determine that the charged voltage VC is sufficient. Satisfaction of this determination is one additional condition for allowing the shift from the power saving mode to the indication mode.

The thus-set mode is stored in the mode storage 94, and the stored information is supplied to the driving control circuit 24, the time information storage 96, and the setting value changing portion 95. Upon the shift from the indication mode to the power saving mode, the driving control circuit 24 stops supply of the pulse signal to the driving unit E, thereby stopping the operation of the driving unit E. Accordingly, the motor 10 ceases rotation and the time indication is stopped.

Next, the time information storage 96 is made up of a counter and a memory (though not shown). The time information storage 96 receives the reference signal produced by the pulse synthesis circuit 22 and starts time counting upon the shift from the indication mode to the power saving mode, and finishes the time counting upon the shift from the power saving mode to the indication mode. As a result, a duration time during which the power saving mode is maintained is measured. The duration time of the power saving mode is stored in the memory. Further, upon the shift from the power saving mode to the indication mode, the time information storage 96 counts fast-forward pulses supplied from the driving control circuit 24 to the driving unit E by using the counter, and when the counted value reaches a value corresponding to the duration time of the power saving mode, the storage 96 produces a control signal to stop delivery of the fast-forward pulses and supplies the control signal to the driving unit E. Accordingly, the time information storage 96 also has a function of causing the resumed time indication to be restored to the current time. Incidentally, the contents of both the counter and the memory are reset at the timing of the shift from the indication mode to the power saving mode.

Next, the driving control circuit 24 produces the driving pulses depending on the mode on the basis of the pulses outputted from the pulse synthesis circuit 22. First, in the power saving mode, the driving control circuit 24 stops the supply of the driving pulses. Then, immediately after the shift from the power saving mode to the indication mode, the driving control circuit 24 supplies, as the driving pulses, fast-forward pulses with shorter pulse intervals causing the resumed time indication to be restored to the current time. Then, after finishing the supply of the fast-forward pulses, the driving control circuit 24 supplies the driving pulses with normal pulse intervals to the driving unit E.

[2.1.6] Power-Generation-State Detecting Portion

Next, the construction of the power-generation-state detecting portion 91 will be described with reference to the drawing.

Figure 6:
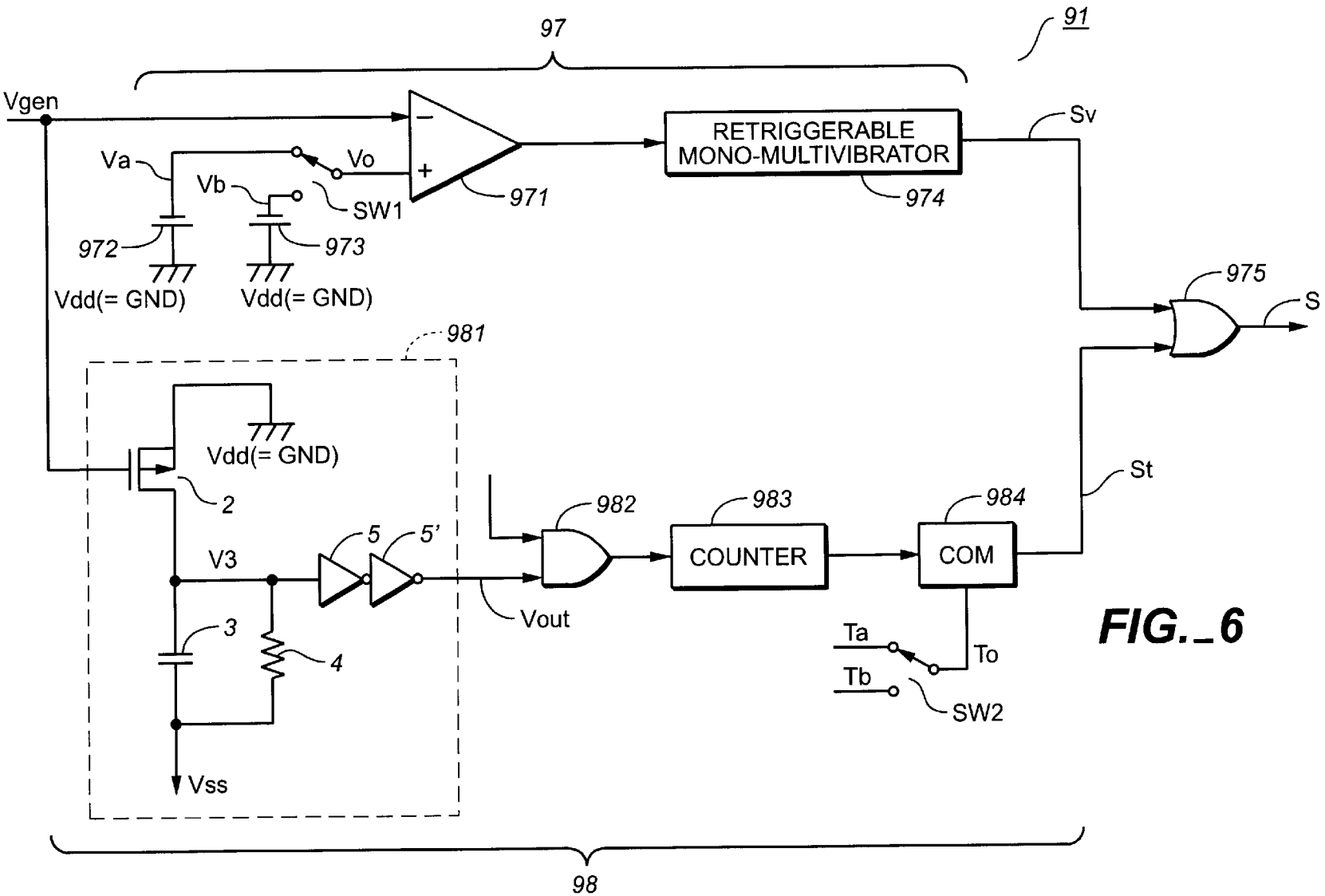
FIG. 6 is a circuit diagram of a power-generation-state detecting portion according to the second embodiment.

FIG. 6 is a circuit diagram of the power-generation-state detecting portion 91.

In FIG. 6, the first detecting circuit 97 produces a voltage detecting signal Sv which assumes a high level when the magnitude of electromotive voltage Vgen exceeds above a predetermined voltage, and a low level when it falls below the predetermined voltage. On the other hand, the second detecting circuit 98 produces a power-generation-duration-time detecting signal St which assumes a high level when the power generation duration time exceeds above a predetermined time, and a low level when it falls below the predetermined time. Also, the logical combination of the voltage detecting signal Sv and the power-generation-duration time detecting signal St is calculated by an OR circuit 975, and is then supplied as a power-generation-state detecting signal S to the central control circuit 93. The power-generation-state detecting signal S indicates the state of generating power when it assumes a high level, and the state of not generating power when it assumes a low level. Accordingly, as described above, if any one of the conditions determined by the first and second detecting circuits 97 and 98 is satisfied, the power-generation-state detecting portion 91 determines that power is generated. The first detecting circuit 97 and the second detecting circuit 98 will be described below in detail.

[2.1.6.1] First Detecting Circuit

[2.1.6.1.1] Construction of First Detecting Circuit

In FIG. 6, the first detecting circuit 97 is mainly made up of a comparator 971, reference voltage sources 972, 973 for generating a constant voltage, a switch SW1, and a retriggerable mono-multivibrator 974. A value of the voltage generated by the reference voltage source 972 is equal to the setting voltage value Va in the indication mode, whereas a value of the voltage generated by the reference voltage source 973 is equal to the setting voltage value Vb in the power saving mode. The reference voltage sources 972, 973 are connected to a positive input terminal of the comparator 971 through the switch SW1. The switch SW1 is controlled by the setting value changing portion 95 such that the reference voltage source 972 is connected to the positive input terminal of the comparator 971 in the indication mode, and the reference voltage source 973 is connected to the positive input terminal of the comparator 971 in the power saving mode. Also, the electromotive voltage Vgen generated in the power generation unit A is supplied to a negative input terminal of the comparator 971. Thus, the comparator 971 compares the electromotive voltage Vgen with the setting voltage value Va or the setting voltage value Vb, and produces a comparison result signal which assumes a high level when the electromotive voltage Vgen is less (more negative) than those setting voltage values (namely, has a larger amplitude), and which assumes a low level when the electromotive voltage Vgen is more (less negative) than those setting voltage values (namely, has a smaller amplitude).

The retriggerable mono-multivibrator 974 produces a signal which is triggered so as to rise from a low level to a high level by a rising edge generating at the time when the comparison result signal rises from a low level to a high level, and which falls from a high level to a low level after a predetermined time has elapsed. Also, when triggered again before the predetermined time elapses, the retriggerable mono-multivibrator 974 resets the counted time and starts over counting time.

[2.1.6.1.2] Operation of First Detecting Circuit

Next, the operation of the first detecting circuit 97 will be described with reference to FIG. 7.

Figure 7A:
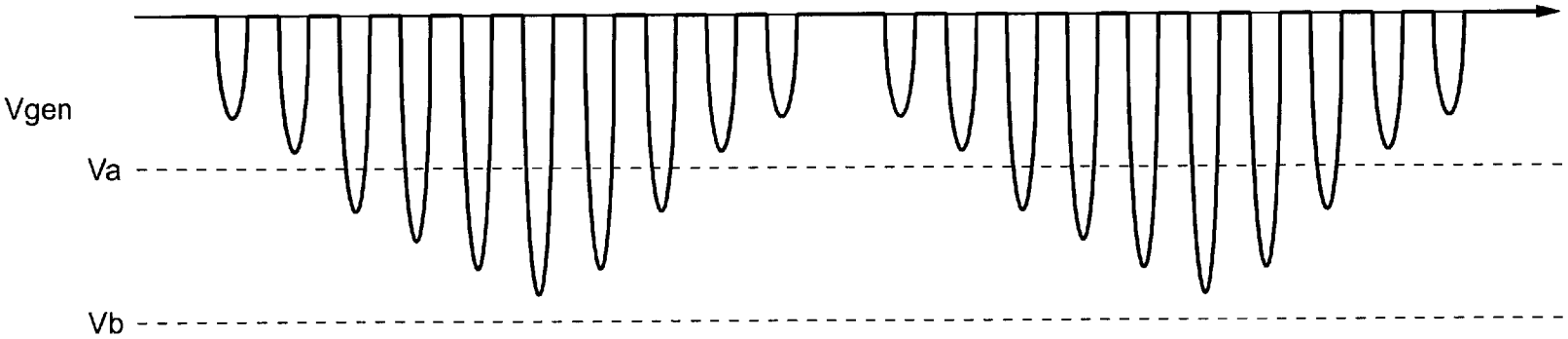
FIGS. 7*a*–7*c* are timing charts for explaining the operation of a first detecting circuit according to the second embodiment.
Figure 7B:
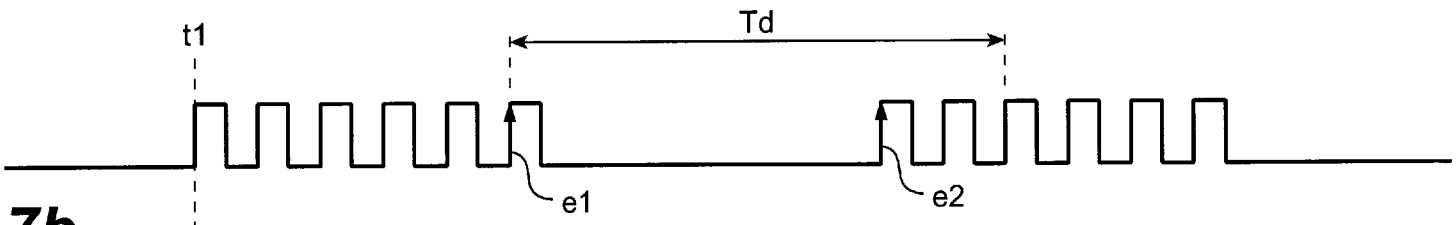
Figure 7C:
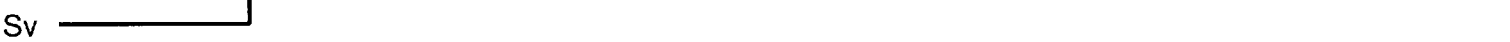
Figure 8A:
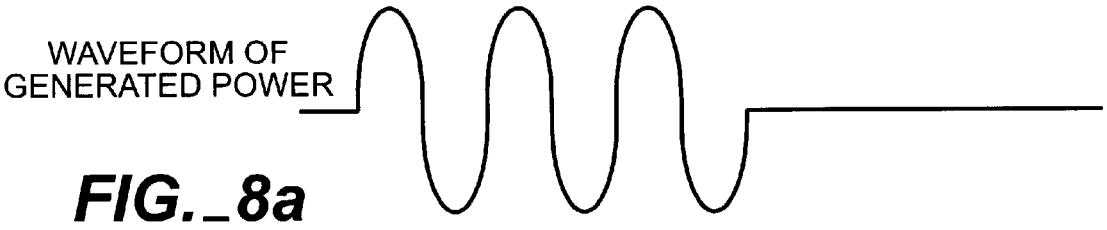
FIGS. 8*a*–8*f* are timing charts for explaining the operation of a second detecting circuit according to the second embodiment.
Figure 8B:
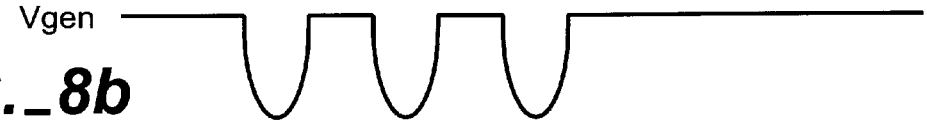
Figure 8C:
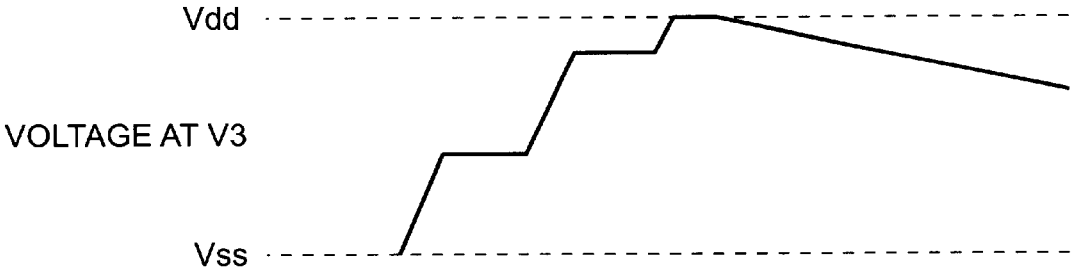
Figure 8D:
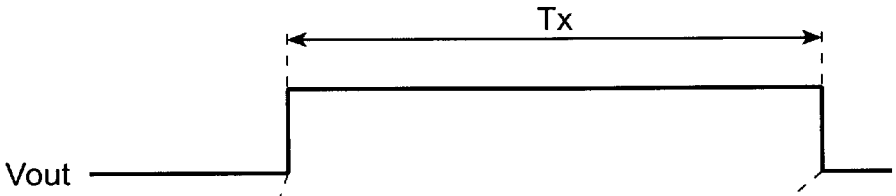
Figure 8E:
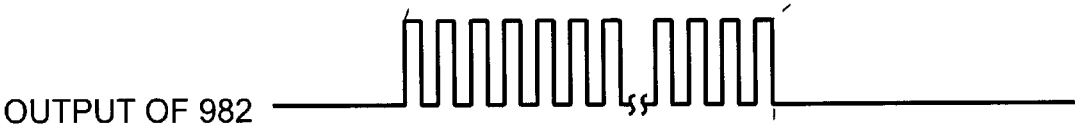
Figure 8F:
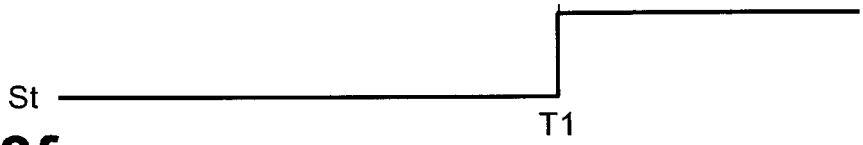

FIG. 7 is a timing chart for the first detecting circuit 97.

FIG. 7(*a*) shows the waveform of an electromotive voltage Vgen resulting after half-wave rectification by the diode 47. In this embodiment, it is assumed that the setting voltage values Va and Vb are set to levels shown in FIG. 7(*a*). Letting the current mode be the indication mode, the switch SWI selects the reference voltage source 972 and supplies the setting voltage value Va to the comparator 971.

Then, the comparator 971 compares the setting voltage values Va and the electromotive voltage Vgen shown in FIG. 7(*a*), and produces the comparison result signal shown in FIG. 7(*b*). In this case, the retriggerable mono-multivibrator 974 is triggered to rise from a low level to a high level in synch with a rising edge of the comparison result signal which generates at the time t1 (see FIG. 7(*c*)).

Here, a delay time Td of the retriggerable mono-multivibrator 974 is shown in FIG. 7(*b*). In this case, because a period of time from one edge el to a next edge e2 is shorter than the delay time Td, the voltage detecting signal Sv maintains a high level.

On the other hand, letting the current mode be the power saving mode, the switch SW1 selects the reference voltage source 973 and supplies the setting voltage value Vb to the comparator 971. In this embodiment, because the electromotive voltage Vgen does not exceed the setting voltage value Vb, the retriggerable mono-multivibrator 974 is not triggered. Accordingly, the voltage detecting signal Sv maintains a low level.

Thus, the first detecting circuit 97 compares the electromotive voltage Vgen with the setting voltage value Va or Vb, thereby producing the voltage detecting signal Sv.

[2.1.6.2] Second Detecting Circuit

[2.1.6.2.1] Construction of Second Detecting Circuit

In FIG. 6, the second detecting circuit 98 is made up of an integrating circuit 981, a gate 982, a counter 983, a digital comparator 984, and a switch SW2.

First, the integrating circuit 981 is made up of a MOS transistor 2, a capacitor 3, a pull-up resistor 4, and an inverter circuit 5. The electromotive voltage Vgen is connected to a gate of the MOS transistor 2, whereby the MOS transistor 2 repeats on- and off-operations in accordance with the electromotive voltage Vgen to control charging of the capacitor 3. If a switching means is constructed of a MOS transistor, the integrating circuit 981 including the inverter circuit 5 can be constructed of an inexpensive CMOS IC. However, the switching element and voltage detecting means may be constructed of bipolar transistors. The pull-up resistor 4 serves to fix a voltage value V3 of the capacitor 3 to the potential Vss in the state of not generating power, and also to generate a leakage current the state of not generating power. The pull-up resistor 4 has a high resistance value on the order of several tens to several hundreds MΩ, and may be constructed of a MOS transistor having a large resistance at turning-on. The inverter circuit 5 connected to the capacitor 3 determines the voltage value V3 of the capacitor 3. The inverter circuit 5 outputs a detection signal Vout. Here, a threshold of the inverter circuit 5 is set to a setting voltage value Vbas that is fairly smaller than the setting voltage value Vo used in the first detecting circuit 97.

The reference signal supplied from the pulse synthesis circuit 22 and the detection signal Vout are supplied to the gate 982. Accordingly, the counter 983 counts the reference signal during a period in which the detection signal Vout maintains a high level. A counted value is supplied to one input of the digital comparator 984. Also, the setting time value To corresponding to the setting time is supplied to the other input of the digital comparator 984. When the current mode is the indication mode, the setting time value Ta is supplied through the switch SW2, and when the current mode is the power saving mode, the setting time value Th is supplied through the switch SW2. Additionally, the switch SW2 is controlled by the setting value changing portion 95.

The digital comparator 984 outputs the comparison result signal, as a power-generation-duration-time detecting signal St, in synch with a falling edge of the detection signal Vout. The power-generation-duration-time detecting signal St assumes a high level when the duration time exceeds above the setting time, and a low level when the duration time falls below the setting time.

[2.1.6.2.2] Operation of Second Detecting Circuit

Next, the operation of the second detecting circuit 98 will be described with reference to FIG. 8.

FIG. 8 is a timing chart for explaining the operation of the second detecting circuit 98.

When generation of AC power shown in FIG. 8(*a*) is started in the power generation unit A, the power generator 40 produces an electromotive voltage Vgen shown in FIG. 8(*b*) through the diode 47. When a voltage value of the electromotive voltage Vgen falls from Vdd' down to Vss after the start of power generation, the MOS transistor 2 is turned on to start charging of the capacitor 3. The potential at V3 is fixed to the Vss side by the pull-up resistor 4 in the state of not generating power, but begins to rise toward the Vdd side when the charging of the capacitor 3 starts subsequent to the power generation. Then, when the value of the electromotive voltage Vgen increases toward Vss and the MOS transistor 2 is turned off, the charging of the capacitor 3 is stopped, but the potential at V3 is held at the same level as shown in FIG. 8(*c*). The above operation is repeated during a period in which the power generation is continued, and the potential at V3 is stabilized after rising to Vdd. When the potential at V3 rises above the threshold of the inverter circuit 5, the detection signal Vout as an output of the inverter circuit 5' shifts from a low level to a high level, whereupon the power generation is detected. A response time to the detection of power generation can be optionally set by connecting a current limiting resistor, or changing a capability of the MOS transistor to adjust the value of a charging current to the capacitor 3, or changing the capacity value of the capacitor 3.

When the power generation is stopped, the electromotive voltage Vgen is stabilized at the Vdd level and therefore the MOS transistor 2 is kept in an off-state. The voltage at V3 is continuously held for a while by the capacitor 3, but the charge in the capacitor 3 escapes due to a slight leakage current through the pull-up resistor 4. Accordingly, V3 starts to gradually fall from Vdd toward Vss. Then, when V3 falls below the threshold of the inverter circuit 5, the detection signal Vout as an output of the inverter circuit 5' shifts from a high level to a low level, whereupon it is detected that power is not generated (see FIG. 8(*d*)). A response time to the detection of non-power generation can be optionally set by changing the resistance value of the pull-up resistor 4 to adjust a leakage current from the capacitor 3.

Gating the reference signal by the detection signal Vout produces a signal shown in FIG. 8(*e*), and the produced signal is counted by the counter 983. A counted value is compared in the digital comparator 984 with the value corresponding to the setting time at timing T1. Here, if a high level period Tx of the detection signal Vout is longer than the setting time value To, the power-generation-duration-time detecting signal St changes from a low level to a high level at the timing T1 as shown in FIG. 8(*f*).

The electromotive voltage Vgen produced depending on a difference in rotational speed of the power generating rotor 43 and the detection signal Vout resulting from the electromotive voltage Vgen will now be described with reference to FIG. 9.

Figure 9A:
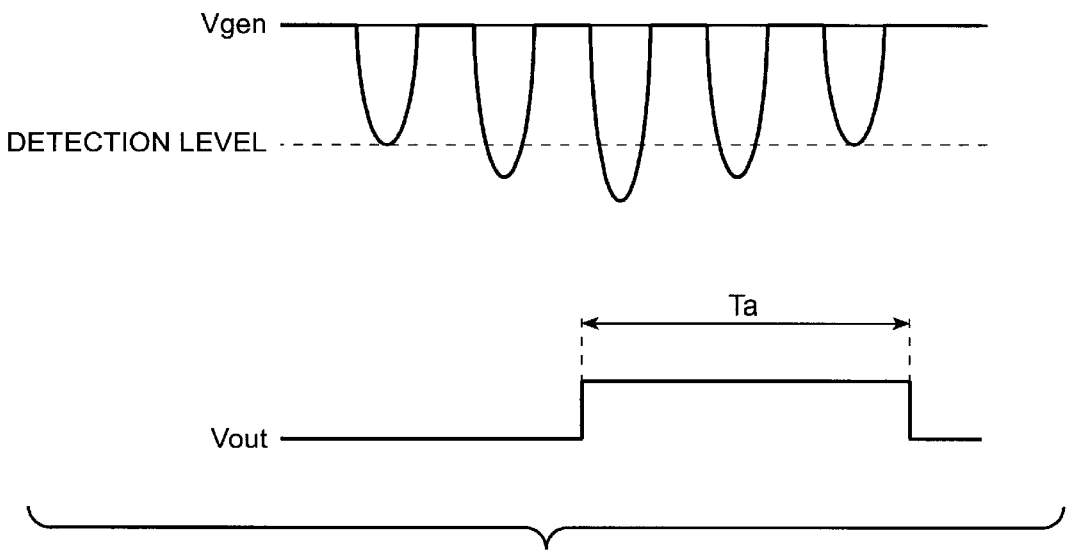
FIGS. 9*a*–9*b* conceptual views for explaining an electromotive voltage produced depending on a difference in rotational speed of a power generating rotor and the relation of a detection signal with respect to the electromotive voltage in the second embodiment.
Figure 9B:
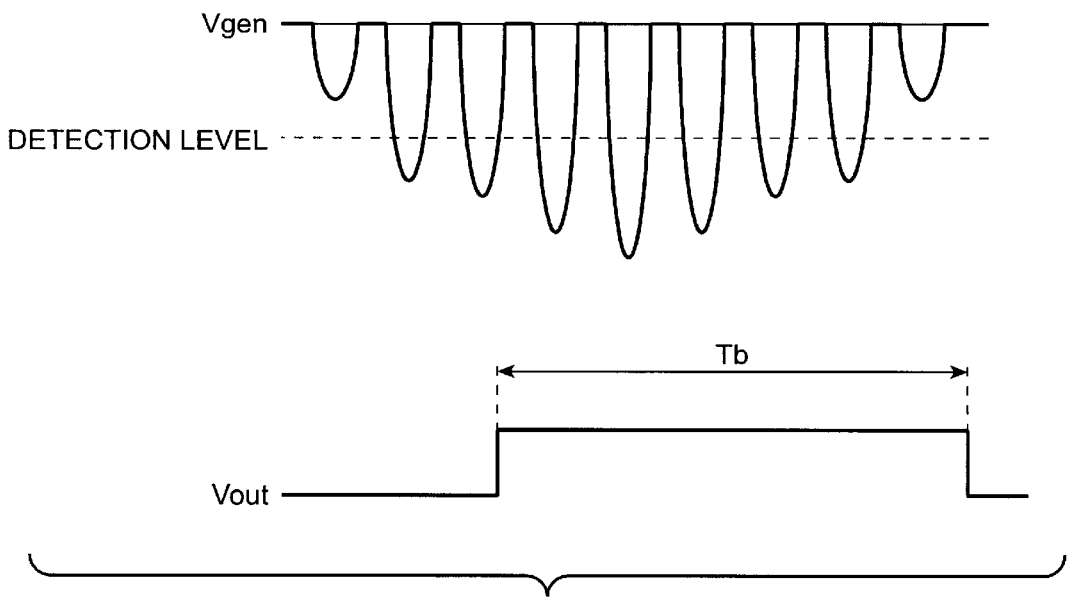

FIG. 9 is a conceptual view for explaining the electromotive voltage Vgen produced depending on a difference in rotational speed of the power generating rotor 43 and the relation of the detection signal Vout with respect to the electromotive voltage Vgen.

In particular, FIG. 9(*a*) represents the case where the rotational speed of the power generating rotor 43 is small, and FIG. 9(*b*) represents the case where the rotational speed of the power generating rotor 43 is large. A voltage level and cycle (frequency) of the electromotive voltage Vgen change depending on the rotational speed of the power generating rotor 43. In other words, the higher the rotational speed, the larger is the amplitude of the electromotive voltage Vgen and the shorter is the cycle thereof. Therefore, the length of an output holding time (power generation duration time) of the detection signal Vout changes depending on the rotational speed of the power generating rotor 43, i.e., the intensity of power generation. Specifically, when the motion is small as shown in FIG. 9(*a*), the output holding time is ta, and when the motion is large shown in FIG. 9(*b*), the output holding time is tb. The relationship between ta and tb is ta<tb. The intensity of power generation in the power generator 40 can be determined from the length of the output holding time of the detection signal Vout.

[2.2] Operation of Timepiece

Next, mode setting steps for carrying out a mode changing process in the timepiece 1 of this second embodiment will be described.

FIG. 10 is a flowchart showing a summary of the mode setting steps.

First, the current mode is determined in step 71. If the current mode is under power saving, counting of the suspension time is continued by the time information storage 96 in step 74. Then, the setting values Vo and To in the power-generation-state detecting portion 91 are set to the values Vb and Tb for the power saving mode in step 75. On the other hand, if the current mode is the indication mode, the driving control portion 24 controls the driving circuit 30 to produce the driving pulses and effects the time indication in step 72. Then, the setting values Vo and To in the power-generation-state detecting portion 91 are set to the values Va and Ta for the indication mode in step 73.

Next, a power generation level (electromotive voltage) is detected in step 76. If it is determined in step 76 that the electromotive voltage is produced even though its level is small, the power generation duration time Tgen is counted up in step 77. Then, the power generation duration time Tgen is compared with the setting time To in step 78. If the power generation duration time Tgen is not less than the setting time To, processing goes to step 80 upon a decision that power generation is detected. If it is determined in step 78 that the power generation duration time Tgen does not reach the setting time To, the electromotive voltage Vgen is compared with the setting value Vo in step 79. If the electromotive voltage Vgen reaches the setting value Vo, processing goes to step 80 upon a decision that power generation is detected. In step 80, the mode is determined again. If the mode is not the power saving mode, the non-power-generation time Tn is cleared in step 81, following which processing returns to step 71 and continues the time indication in step 72. Conversely, if the mode is the power saving mode, the charged voltage VC of the power supply unit B is determined in step 82. If the power supply unit B is sufficiently charged, the mode is shifted from the power saving mode to the indication mode and the power saving mode is cleared in step 83. When the time is indicated again upon the shift to the indication mode, the time indication is fast forwarded in accordance with the suspension time counted by the time information storage 96, and normal rotation of the hands per second is started after restoring to the current time, as described above. As a result, the user can view the precise time indicated after returning to the indication mode.

On the other hand, if the electromotive voltage is not detected in step 76, or if the power generation duration time Tgen does not reach the setting time To and the electromotive voltage Vgen also does not reach the setting value Vo, processing goes to step 85 upon a decision that power generation is not detected, where the mode at that time is determined. In this respect, when the electromotive voltage is not detected in step 76, the power generation duration time Tgen is cleared in step 84. If the mode is determined to be the power saving mode in step 85, processing returns to step 71 directly to continue counting-up of the suspension time. If the mode is determined to be the indication mode, the non-power-generation time Tn is counted up in step 86, and whether a predetermined non-power-generation time is continued or not is determined in step 87. If the non-power-generation time Tn has elapsed, the mode is shifted from the indication mode to the power saving mode in step 88, thereby starting the power saving. In step 88, the operations of both the driving control circuit 24 and the driving circuit 30 are stopped to reduce power consumption of the motor 10, and counting of the suspension time is started by the time information storage 96.

[2.3] Advantages of Second Embodiment

Thus, in the timepiece 1 of this embodiment, the time indication is stopped or resumed depending on whether power is generated or not. As described above, the power generator 40 in this embodiment is such a system that power is generated by motion of the user's arm or vibration with the aid of the rotating weight 45. Accordingly, the fact that power generation is detected means that the timepiece is fitted on the user's arm, or that the user carries the timepiece while putting it in a pocket or the like. In view of the above, when power generation is detected, the mode is shifted to the indication mode in which the time is indicated, upon a decision that the timepiece is carried by the user. Conversely, when power generation is not detected, the mode is shifted to the power saving mode in which the time is not indicated, upon a decision that the timepiece is not carried by the user. As a result, the energy accumulated in the large-capacity capacitor 48 can be saved.

Further, in the timepiece 1 of the second embodiment, it is determined that power generation is detected when the predetermined electromotive voltage Vgen is detected, and when power generation is continued for the predetermined time.

Therefore, even when the mode is shifted to the power saving mode in a condition of the timepiece being not carried by the user and power generation is then accidentally induced for some reason, e.g., vibration, the mode is kept from shifting to the indication mode if the electromotive voltage is weak and the duration time is short. Useless consumption of energy can be thus prevented. On the other hand, in the indication mode, since the setting value Vo is set to be lower than in the power saving mode, it is determined that power generation is detected, if the electromotive voltage is obtained even though the detected electromotive voltage Vgen is somewhat low. As a result, the time indication is continued so long as power is generated even at a low level. Also, in the indication mode, since the setting time To for the power generation duration time Tgen is also set to be shorter, the time indication is maintained so long as power is generated even for a short time.

Moreover, in the timepiece 1 of the second embodiment, the non-power-generation time Tn is measured, and the mode is not shifted to the power saving mode unless the non-power-generation time reaches the setting time.

Accordingly, it is possible to maintain the time indication not only in the case where motion of the user is stopped and power is not generated for a short time, but also in the case where the user takes off the wristwatch for a period of time such as during a meeting. Also, the time may be continuously indicated even when the user takes off the wristwatch all night. As an alternative, for the purpose of saving energy, the mode may be shifted to the power saving mode if the user takes off the wristwatch for a period of about five minutes.

As described above, with the timepiece 1 of this second embodiment, whether the timepiece is carried by the user or not can be automatically determined based on the power generation state. Then, the timepiece can sufficiently function as a wristwatch or the like by indicating the time when carried by the user, and can reduce consumption of energy without indicating the time when not carried by the user. Accordingly, the power once charged in the large-capacity capacitor 48 can be effectively utilized. Even with the timepiece left standing for a long time, the time is not indicated and only the elapsed time is measured during such a period of time. When the user wears the timepiece again, the time indication is resumed and restored to the current time, thereby indicating the precise time. With no need of employing a capacitor being so large in capacity, therefore, a small size wristwatch or the like capable of keeping time for a long time with good accuracy can be realized by incorporating, in place of a battery, a power generator and a capacitor having an appropriate capacity. Also, since the capacity of a capacitor is not required to be so large, a timepiece can be realized which has a good start-up characteristic, and can resume the indication and restore to the current time as soon as power generation is started. In addition, with the timepiece of this embodiment, the user can always see the time regardless of surrounding conditions even in a dark place, for example, when carried by the user, and therefore the user is free from inconvenience.

[2.4] Modifications of Second Embodiment

[2.4.1] First Modification

In the above description of the second embodiment, the power-generation-state detecting portion 91 detects the power generation state based on the electromotive voltage Vgen from the power generation unit A. However, the power generation state may be detected in the power supply unit B based on a charging current flowing into the large-capacity capacitor 48.

Figure 11:
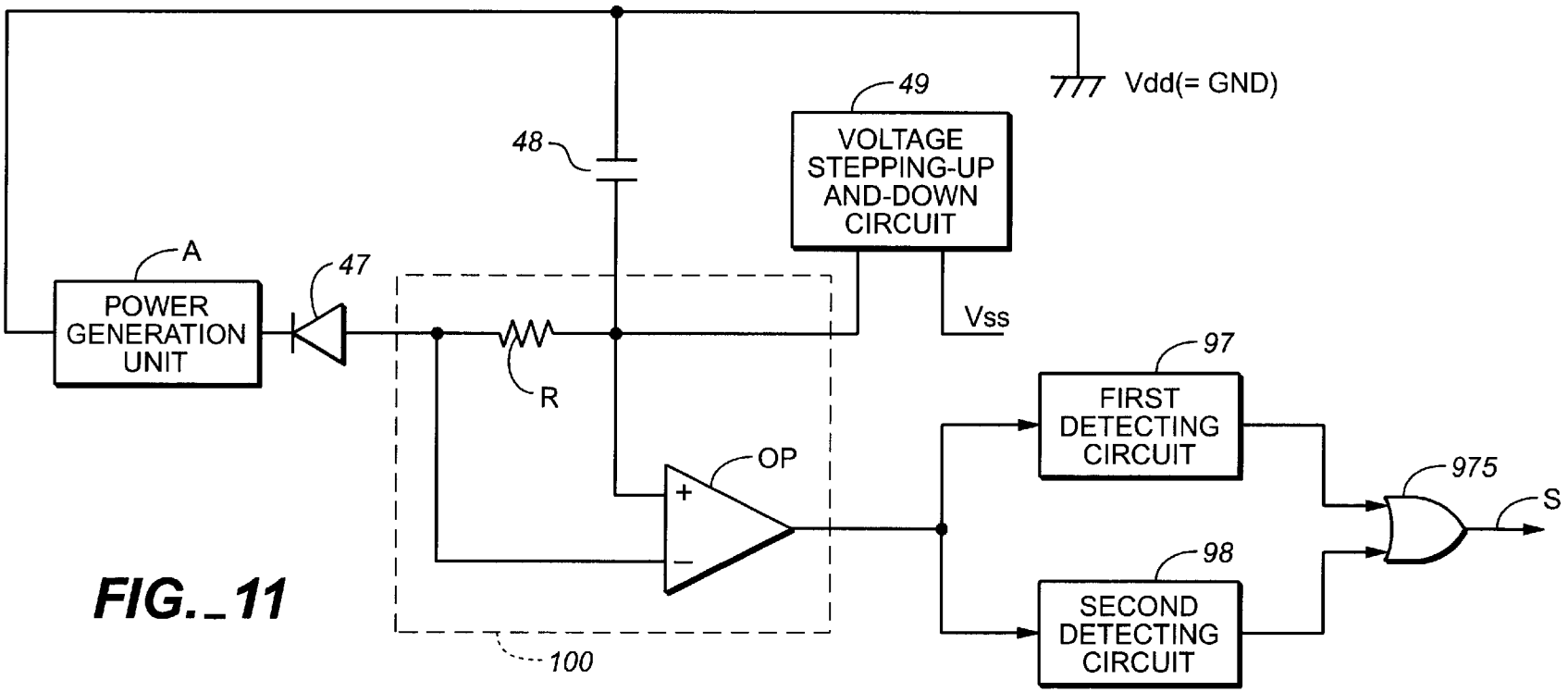
FIG. 11 is a block diagram showing a construction of a power-generation-state detecting portion according to a modification of the second embodiment.

In this case, as shown in FIG. 11, a current-to-voltage converter 100 may be disposed upstream of the first detecting circuit 97 and the second detecting circuit 98. The current-to-voltage converter 100 is made up of a current detecting resistor R and an operational amplifier OP for detecting a potential difference across the resistor R.

[2.4.2] Second Modification

Further, the above description of the second embodiment has been made employing the power generation state detecting portion 91 which includes both the first detecting circuit 97 for comparing the electromotive voltage Vgen with the setting value Vo and then determining whether power generation is detected, and the second detecting circuit 98 for comparing the power generation duration time Tgen, during which the electromotive voltage Vgen not lower than the voltage Vbas fairly smaller than the setting value Vo is obtained, with the setting value To and then determining whether power generation is detected. However, whether power is generated or not can be of course also determined by using one of the first and second detecting circuits 97 and 98.

[3] Third Embodiment

Next, a timepiece according to a third embodiment of the present invention will be described.

The timepiece of the third embodiment is similarly constructed as the timepiece of the second embodiment except the construction of the power generation state detecting portion 91.

The frequency of power generated in the power generation unit A changes depending on the intensity of power generation. For example, when the timepiece 1 put on a desk is slightly moved by some accident, the frequency of the generated power is low, but when the user is walking while wearing the timepiece 1 on his wrist, the frequency of the generated power is increased. Also, when the user tries to charge the timepiece 1 by shaking his wrist, the frequency of the generated power is further increased. This embodiment has been made in view of the above point, and intends to detect the power generation state based on the frequency of the generated power.

[3.1] Construction of Power-Generation-State Detecting Portion

Figure 12:
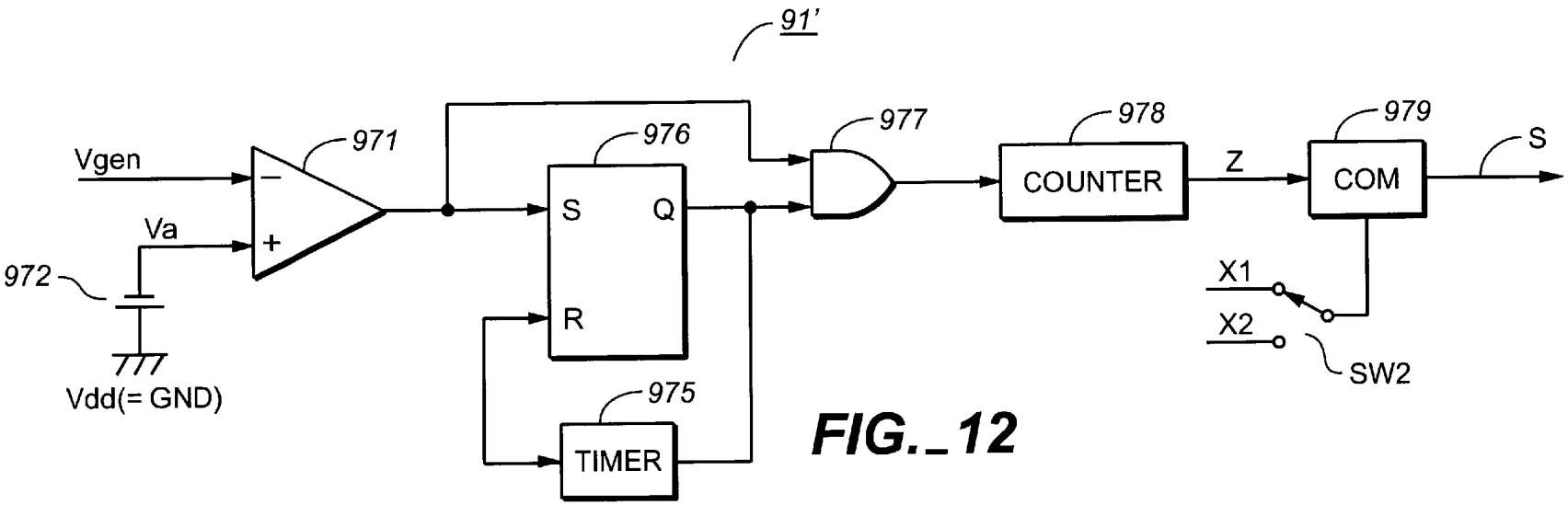
FIG. 12 is a block diagram of a power-generation-state detecting portion according to a third embodiment of the present invention.

FIG. 12 shows a block diagram of a power-generation-state detecting portion 91' according to the third embodiment.

Figure 13A:
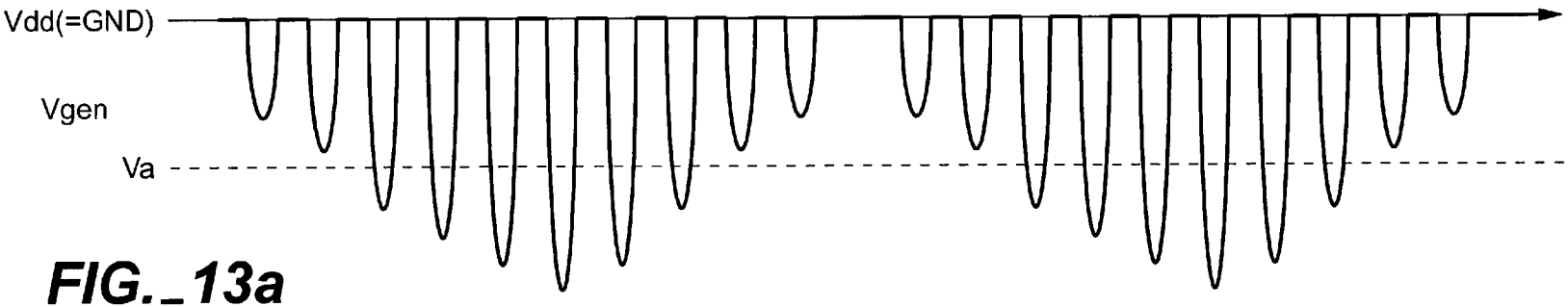
FIGS. 13*a*–13*c* are timing charts of the power-generation-state detecting portion according to the third embodiment.
Figure 13B:
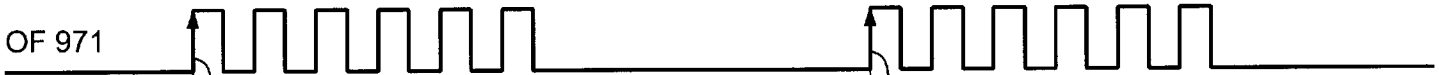
Figure 13C:
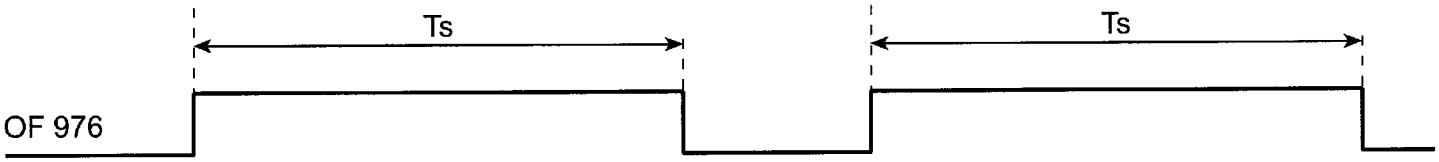

Also, FIG. 13 shows a timing chart of the power-generation-state detecting portion 91' according to the third embodiment.

The power-generation-state detecting portion 91' is made up of a comparator 971, a reference voltage source 972 for generating a constant voltage, a switch SW2, and a timer 975, as well as an SR flip-flop 976, a gate 977, a counter 978, and a digital comparator 979.

The reference voltage source 972 generates the setting voltage value Va in the indication mode, and is connected to a positive input terminal of the comparator 971. Also, the electromotive voltage Vgen generated in the power generation unit A, shown in FIG. 13(*a*), is supplied to a negative input terminal of the comparator 971. Thus, the comparator 971 compares the electromotive voltage Vgen with the setting voltage value Va, and produces a comparison result signal which assumes a high level when the electromotive voltage Vgen is less (greater negative amplitude) than the setting voltage value Va, and which assumes a low level when the electromotive voltage Vgen is more (less negative amplitude) than the setting voltage values Va (see FIG. 13(*b*)).

The comparison result signal is supplied to a set terminal of the SR flip-flop 976, and an output signal of the timer 975 is supplied to a reset terminal of the SR flip-flop 976. The timer 975 is designed so as to start counting of time in synch with rising of an output signal of the SR flip-flop 976, and to fall after upon the elapse of a predetermined time. Assuming here the timer counting time to be Ts, as shown in FIG. 13(*c*), the output signal of the SR flip-flop 976 changes from a low level to a high level in synch with each rising edge e3, e4 of the comparison result signal, and falls from a high level to a low level after maintaining a high level for the time Ts.

The gate 977 outputs the logical and of the output signal of the SR flip-flop 976 and the comparison result signal. The counter 978 counts an output signal of the gate 977, and then outputs a counted value Z to the digital comparator 979. A setting value X1, X2 is selectively supplied to the digital comparator 979 through the switch SW2. The switch SW2 is controlled by the setting value changing portion 95, and supplies, to the digital comparator 979, the setting value X1 in the indication mode and the setting value X2 in the power saving mode. The setting value X1 corresponds to a frequency f1 of the generated power based on which it is possible to determine whether power is generated in a normal carried state, and the setting value X2 corresponds to a frequency f2 of the generated power based on which it is possible to determine whether forcible charging is made. The digital comparator 979 is designed so as to compare the setting value X1 or X2 with the counted value Z of the counter 978 at a falling edge of the signal from the gate 977.

When the current operating mode is the power saving mode, a power-generation-state detecting signal S indicating the state of power generation is produced when the frequency of power generated in the power generation unit A exceeds above f2. Accordingly, the power saving mode is not cleared when the timepiece is in a normal carried state, and the mode is shifted from the power saving mode to the indication mode only when the user tries forcible charging (by shaking his wrist) with the intention of clearing the power saving mode. Thus, even when the timepiece 1 is slightly touched or the like, the power saving mode is not cleared and useless consumption of power is avoided.

On the other hand, when the current operating mode is the indication mode in which the time is indicated, a power-generation-state detecting signal S indicating the state of power generation is produced when the frequency of power generated in the power generation unit A falls below f1. Since the frequency of the generated power f1 is set, as described above, to a value based on which it is possible to determine whether power is generated in a normal carried state, the mode can be promptly shifted from the indication mode to the power saving mode by precisely detecting a condition where the timepiece is not used. As a result, useless consumption of power is avoided.

[4] Fourth Embodiment

Each of the above-described embodiments employs, as the power generator 40, an electromagnetic induction power generator wherein rotating motion (=kinetic energy) of the rotating weight 45, produced when the timepiece is carried by the user, is transmitted to the rotor 43, and the electromotive voltage Vgen is generated in the output coil 44 with the rotation of the rotor 43. In this fourth embodiment, the power generator 40 is replaced by a power generator of the type that it is brought into a power-generation disabled state depending on ambient environment even when the timepiece is carried with the user.

In the case of using such a power generator, when the operating mode is controlled depending on the power generation state of the power generator, the timepiece is not always brought into the state of generating power even with the timepiece being carried by the user, and is not always brought into the state of not generating power even with the timepiece being not carried by the user.

In the above case, the problem is that even when the timepiece is in the state carried by the user and the power generator still remains in the state of not generating power, the operating mode may be shifted from the power saving mode to the indication mode (normal operating mode). If such an event happens, the timepiece would turn into the indication mode in spite of being in the state of not generating power, and the power would be so diminished as to stop the timepiece.

The power generator that possibly causes the above problem is, e.g., a solar cell. In the solar cell, power is generated by converting optical energy (corresponding to first energy) of extraneous light, such as sunlight, into electric energy with photoelectric conversion.

The fourth embodiment will be described below in detail in connection with an example in which a solar cell is employed as the power generator.

Figure 14:
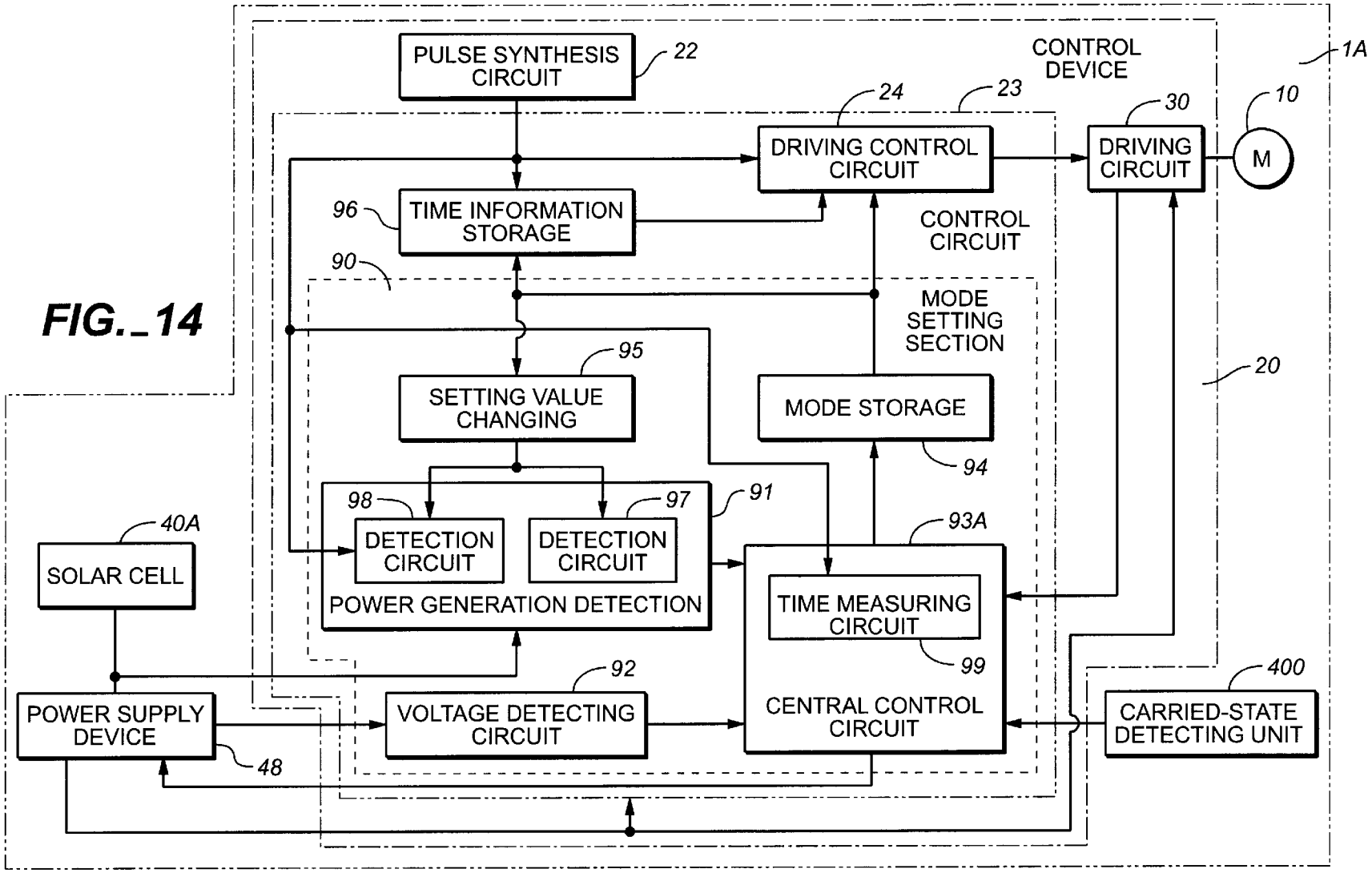
FIG. 14 shows, in the form of a schematic block diagram, a construction of a timepiece according to a fourth embodiment of the present invention.

FIG. 14 is a block diagram showing a schematic construction of a timepiece of the fourth embodiment. In FIG. 14, the same components as those in the first embodiment of FIG. 2 are denoted by the same numerals, and detailed description thereof is omitted here.

The fourth embodiment differs from the first embodiment in that a carried-state detecting unit 400 for determining whether the timepiece is in the state carried by the user, i.e., whether the user is wearing the timepiece, is provided, and a central control circuit 93A restores the operating mode from the power saving mode to the indication mode only when the timepiece 1A is in the state carried by the user and a power generator (solar cell) 40A is in the state of generating power.

[4.1] Carried-state Detecting Unit

Concrete examples of the carried-state detecting unit will be first described.

Conceivable constructions of the carried-state detecting unit are, for example, below.

(1) A carried-state detecting unit including an acceleration sensor to detect acceleration when the timepiece is carried by the user.

(2) A carried-state detecting unit including a contact electrode sensor to detect a change in current value, voltage value, resistance value, or capacitance value between electrodes when the user is wearing the timepiece.

(3) A carried-state detecting unit including a mechanical contact sensor to detect whether the user is wearing the timepiece or not, by detecting an on- or offstate of a mechanical contact when the user is wearing the timepiece.

[4.1.1] Carried-state Detecting Unit Including Acceleration Sensor

In a carried-state detecting unit including an acceleration sensor, the acceleration sensor is disposed, by way of example, to detect acceleration in the planar direction of a timepiece dial. The acceleration sensor detects acceleration corresponding to motion of the timepiece when the user is wearing the timepiece, and the carried-state detecting unit detects that the user is wearing the timepiece, i.e., that the timepiece is carried by the user, when acceleration not smaller than a predetermined acceleration set beforehand is detected.

In this case, various states in which the timepiece is carried by the user can be detected by setting the predetermined acceleration to a value corresponding to desired acceleration to be detected.

Further, by detecting the carried state of the timepiece only when acceleration not smaller than the predetermined acceleration is continuously detected for a period of time not less than a predetermined time set beforehand, the operating mode is surely avoided from erroneously shifting from the power saving mode to the indication mode (normal operating mode).

[4.1.2] Carried-state Detecting Unit Including Contact Electrode Sensor

This carried-state detecting unit is constructed, by way of example, such that a pair of contact electrodes are provided on the backside of the timepiece 1A so as to contact the user's arm when the user puts the timepiece on the arm.

In this case, a resistance value or a capacitance value between the contact electrodes resulting when the user is not wearing the timepiece, is set to a proper value beforehand. The carried state of the timepiece is detected by detecting a change in detected resistance value, detected current value, detected voltage value, or detected capacitance value between electrodes, which occurs when the user wears the timepiece 1A.

Also, in that case, by detecting the carried state of the timepiece only when a change in detected resistance value, detected current value, detected voltage value, or detected capacitance value is continuously detected for a period of time not less than a predetermined time set beforehand, the operating mode is surely avoided from erroneously shifting from the power saving mode to the indication mode (normal operating mode).

[4.1.3] Carried-state Detecting Unit Including Mechanical Contact Sensor

This carried-state detecting unit is constructed, by way of example, such that a mechanical contact switch is provided on a fastener of a band (watch band) for holding the timepiece 1A on the arm, and the unit detects turning of the mechanical contact switch to an on- or off-state occurring when the user fits the band around the arm.

Alternatively, a movable mechanical contact switch is provided in the mechanism, and the carried state of the timepiece is detected upon turning-on of the mechanical contact switch when the timepiece 1A is inclined to a predetermined angle set beforehand (e.g., when a dial of the timepiece takes a posture vertical to the ground surface).

Further, the carried-state detecting unit of this type may be constructed such that the number of times of turning-on/off is counted during a predetermined period of time, the counted number is compared with a reference number set beforehand, and the carried state of the timepiece is detected when the mechanical contact switch turns on and off in excess of the reference number.

In place of any of the above carried-state detecting units or in addition to it, a power generator for generating power based on kinetic energy such as energy of rotation of a rotating weight, a power generator for generating power based on pressure energy by using a piezoelectric device or the like, or a power generator for generating power based on thermal energy by using a thermoelectric device such as a thermocouple may be used as a power generator. In this case, the carried state of the timepiece can be detected depending on the power generation state of the power generator.

[4.2] Operation of Principal Part of Fourth Embodiment

The operation of a principal part of the fourth embodiment will be described below. Suppose here that the operating mode is the indication mode (normal operating mode) in an initial state.

The non-power-generation time measuring circuit 99 of the central control circuit 93A measures the non-power-generation time Tn during which power generation in a solar cell, used as the power generator 40A, is not detected by the first detecting circuit 97 and the second detecting circuit 98.

Then, regardless of whether the carried-state detecting unit 400 produces a detection output, i.e., in any of the cases where the timepiece is in the carried state and in the not-carried state, the central control circuit 93A shifts the operating mode from the indication mode to the power saving mode when the non-power generation time Tn exceeds a predetermined setting time.

The thus-set operating mode is stored in the mode storage 94, and the stored information is supplied to the driving control circuit 24, the time information storage 96, and the setting value changing portion 95. Upon the shift from the indication mode to the power saving mode, the driving control circuit 24 stops supply of the pulse signal to the driving circuit 30, thereby stopping the operation of the driving circuit 30. Accordingly, the motor 10 ceases rotation and the time indication is stopped.

Also, upon the shift from the indication mode to the power saving mode, the time information storage 96 starts operation as a suspension time counter which receives the reference signal produced by the pulse synthesis circuit 22 and stores a duration time of the power saving mode.

Under the power saving mode, the central control circuit 93A monitors the detection output of the carried-state detecting unit 400 and the power-generation detection outputs of the first detecting circuit 97 and the second detecting circuit 98, and returns the operating mode from the power saving mode to the indication mode only when the timepiece 1A is in the state carried by the user and the solar cell 40A serving as the power generator is in the state of generating power.

Then, upon the shift from the power saving mode to the indication mode, the central control circuit 93A counts fast-forward pulses supplied from the driving control circuit 24 to the driving circuit 30 and causes the resumed time indication to be restored to the current time.

[4.3] Advantages of Fourth Embodiment

With the fourth embodiment, as described above, when the timepiece is not in the carried state (when the user is not employing the timepiece), the operating mode is kept from shifting from the power saving mode to the indication mode (normal operating mode), and useless consumption of power can be avoided.

Also, when the operating mode is shifted from the power saving mode to the indication mode, the user can see the precise time indication whenever the user wants to know the time because the timepiece is in the carried state and in the used state, i.e., because the timepiece is in a condition where the power generator generates power in an amount enough for the indication.

[4.4] Modifications of Fourth Embodiment

[4.4.1] First Modification

In the above description, the central control circuit 93A shifts the operating mode from the indication mode to the power saving mode when the non-power generation time Tn exceeds the predetermined setting time, in any of the cases where the timepiece 1A is in the carried state and in the not-carried state. However, the operating mode may be shifted to the power saving mode only when the voltage of the large-capacity capacitor 48 serving as the power supply corresponds to a voltage capable of restoring the current time when the mode will be shifted to the indication mode again subsequent to the shift to the power saving mode, or only when the voltage of the large-capacity capacitor 48 corresponds to a voltage capable of performing at least the normal hand rotation when the mode win be shifted to the indication mode again subsequent to the shift to the power saving mode.

[4.4.2] Second Modification

The above description has been made in connection with the case where the solar cell serving as the power generator 40A does not produce the generated power (i.e., it is brought into the state of not generating power). However, the present invention is also applicable to the case where power generation is insufficient and the generated power is lower than a predetermined voltage.

[4.4.3] Third Modification

The above description has been made in connection with the case of employing the solar cell as the power generator. However, similar advantages as obtainable with the fourth embodiment can also be obtained in the case of employing a manually wound piezoelectric power generator including a manually winding device to apply vibration to a piezoelectric device, a spring power generator for generating power by utilizing energy accumulated in a spring, or an electromagnetic wave power generator for generating power by utilizing electromagnetic energy propagating in a space.

[4.4.3.1] First Concrete Form of Third Modification of Fourth Embodiment

A manually winding device is provided and rotated to apply vibration to a piezoelectric member.

[4.4.3.2] Second Concrete Form of Third Modification of Fourth Embodiment

In place of the power generator 40A, a power generator receiving stray electromagnetic waves can be employed which generates power with electromagnetic induction by utilizing electromagnetic wave energy of electric waves for broadcasting and communications. More specifically, a plurality of tuning circuits are provided so as to be able to tune and resonate with those of electric waves propagating in a space which have particular frequencies different from each other, and to take out the electric waves of the particular frequencies in the form of power.

[4.4.3.3] Third Concrete Form of Third Modification of Fourth Embodiment

In place of the power generator 40A, a thermal power generator having a thermoelectric transducer, such as a thermocouple, and generating power by utilizing thermal energy is employed. This form can also provide similar advantages as obtainable with the fourth embodiment.

[5] Modifications of Embodiments

[5.1] First Modification

While the above embodiments have been each described in connection with, by way of example, the timepiece indicating the time with the stepping motor 10, the present invention is of course also applicable to another type of timepiece indicating the time with an LCD, etc.

In this case, the time can be continuously counted for a long time while saving power consumed by the LCD, and the precise current time can be always displayed as required.

[5.2] Second Modification

Also, while the above embodiments have been each described in connection with, by way of example, the timepiece indicating the hour, minute and second by one motor, the time may be indicated by driving the hour hand, the minute hand, and the second hand by using a plurality of motors.

As a result, the motors can be driven independently of each other to rotate the hands in a stepwise manner, and the amount of rotation of the hands necessary for restoring to the current time upon the shift from the power saving mode to the indication mode (normal operating mode) can be reduced in comparison with the case of driving all the hands by one motor. It is hence possible to reduce power consumption required for restoring the hands to the current time with fast forward rotation rather than power consumption required for rotating the hands in the indication mode.

Further, by combining backward hand rotation (hand rotation in the counterclockwise direction) and forward hand rotation with each other, the maximum amount of rotation of the hands can be reduced to an amount corresponding to a ½ period (e.g., 6 hours when the hour hand indicates 12 hours), and power consumption required for restoring to the current time can be further reduced.

As a concrete example of driving the hands by a plurality of motors, the timepiece can be constructed such that the hour and minute hands are driven by a first motor and the second hand is driven by a second motor. In this case, the timing to stop the time indication can also be changed for each motor.

More specifically, the power saving mode is prepared in two stages. When the operating mode is shifted from the indication mode to a first power saving mode, driving of only the second motor is stopped to cease the second hand only. This is because the user can still easily grasp the time even with only the second hand ceased, and power consumption can be efficiently reduced by ceasing the second motor which drives the second hand and consumes a large amount of energy.

Then, upon the shift from the first power saving mode to the second power saving mode, the first motor for driving the hour and minute hands is also stopped and power consumption can be further reduced.

As a result, the second indication consuming a large amount of energy because of short intervals of hand rotation can be stopped at earlier timing at which the non-power-generation time is short, whereas the hour and minute indication consuming a relatively small amount of energy because of relatively long intervals of hand rotation can be continued as long as possible.

Moreover, the timepiece may be constructed so as to drive the hour hand by a first motor, the minute hand by a second motor, and the second hand by a third motor.

By thus driving the hands by a plurality of motors, a time required for restoring to the current time can be further shortened.

In addition, the timepiece may be constructed such that the user can change the timing to stop the time indication for each motor in accordance with the user's preference.

Likewise, in a timepiece having a calendar function, a motor for driving a calendar mechanism can be provided separately.

[5.3] Third Modification

While each of the above-described embodiments employs, as the power generator 40, an electromagnetic induction power generator wherein rotating motion (=kinetic energy) of the rotating weight 45 is transmitted to the rotor 43 and the electromotive voltage Vgen is generated in the output coil 44 with the rotation of the rotor 43, the present invention is not limited to those embodiments.

[5.3.1] First Form of Third Modification

A power generator producing rotary motion by restoring forces (=kinetic energy) of a spring and generating an electromotive voltage with the rotary motion can be employed in place of the power generator 40.

[5.3.2] Second Form of Third Modification

A power generator utilizing the piezoelectric effect to convert pressure into electric energy and generating electric power by applying external or self-excited vibration or displacement to a piezoelectric member (piezoelectric device) can be employed in place of the power generator 40.

More specifically, a vibrating piece including a piezoelectric layer is vibrated with the rotation of the rotating weight, thereby generating power.

As an alternative, a manually winding device may be provided so that vibration is applied to a piezoelectric member by rotating the manually winding device.

[5.3.3] Third Form of Third Modification

A power generator utilizing the thermoelectric effect to convert thermal energy into electric energy and generating electric power by applying a temperature difference to a thermoelectric transducer, such as a thermocouple, can be employed in place of the power generator 40.

More specifically, a heat radiating plate is provided on the dial side of the timepiece, a heat absorbing plate for absorbing heat from the user's body is provided on the back side of the timepiece, and the heat radiating plate and the heat absorbing plate are connected to each other by a heat conducting member formed of a material having high thermal conductivity. With this arrangement, a temperature difference can be efficiently held, and efficient power generation can be achieved.

[5.3.4] Fourth Form of Third Modification

The timepiece can be constructed so as to include a plurality of power generators (corresponding to auxiliary power generators) by providing plural ones of the power generators according to the first to third forms of the above third modification in place of the power generator 40, or by providing any of the power generators according to the first to fifth forms of the above third modification in addition to the power generator 40.

With the above arrangement, power generation can be continued by any of the power generators, and more stable power generation and hence stable supply of source power can be achieved.

[5.4] Fourth Modification

While the above embodiments have been each described in connection with, by way of example, the timepiece 1 of wristwatch type, the present invention is not limited to such a timepiece. Electronic equipment, in which the above-described power generation unit A, power supply unit B and control unit C can be provided, may be a pocket watch or the like in addition to a wristwatch.

The present invention is also adaptable for other electronic equipment such as pocket-size calculators, portable phones, portable personal computers, electronic pocketbooks, portable radios, portable VTRs, and portable navigation devices.

In this case, a power consuming portion operating with power supplied from the power supply unit B is provided, the power generation state of the power generation unit A is detected by the power-generation-state detecting portion 91, and the control unit C selectively controls the mode in accordance with a detection result between a power saving mode in which the operation of the power consuming portion is stopped and an operative mode in which the power consuming portion is operated. Specifically, the operative mode corresponds to a used state of a pocket calculator, a portable phone, etc., and the power saving mode corresponds to a non-used state thereof. In the power saving mode, however, the power-generation-state detecting portion 91 is supplied with power to be able to determine whether the user is wearing the electronic equipment. In electronic equipment having display units, particularly, it is desired that screen display be not effected in the power saving mode, but effected in the normal operating mode. This enables the user to know whether the mode is in the power saving mode or the normal operating mode, by seeing the display unit.

Further, in that case, the operating condition at the time of shift to the power saving mode is stored in a memory or the like, and the operating condition with the elapse of time during the power saving mode is also continuously accumulated. Upon restoring to the normal operating mode, the stored and accumulated information is utilized to restore the operating condition based on the current information given by the information including the progress condition, or to restore the normal operating condition based on the current information added with the information including the progress condition.

A self-contained navigation device, for example, can be constructed such that the condition of traveling in the course is not displayed but accumulated, and the normal operating condition is then restored to display the current position based on an accumulated result, or the information regarding the condition of traveling in the course is then displayed when the normal operating mode is restored.

[5.5] Fifth Modification

In each of the above-described embodiments, the user is required to shake the wrist to forcibly charge the timepiece 1 when the mode is shifted from the power saving mode to the indication mode.

On that occasion, power is generated in a larger amount than when the user wearing the timepiece 1 is in normal daily activities, and a level of electromagnetic noise occurring in the power generator 40 may become larger than when the timepiece 1 is usually carried with the user.

As a result, it is thought that the stepping motor 10 is affected by the electromagnetic noise and the indicated ion time becomes incorrect.

In view of the above, this fifth modification is constructed so as to detect the state where power is forcibly generated by the user shaking the wrist, and to produce driving pulses having a wider width in the driving unit E upon detection of such a state. This arrangement enables the stepping motor 10 to be surely operated with the driving pulses having a wider width even when the level of electromagnetic noise occurring in the power generator 40 is increased.

Also, when the timepiece 1 is forcibly charged by the user shaking his wrist, there is a risk that a large charging current may increase variations of the supply source voltage due to the internal resistance of the large-capacity capacitor 48 and may adversely affect the circuit operation.

In view of the above, the timepiece may be constructed so as to detect the state where power is forcibly generated by the user shaking his wrist, and to short-circuit across the power generating stator 42 upon detection of such a state. With this arrangement, variations of the supply source voltage can be suppressed and the circuit can be reliably operated.

[5.6] Sixth Modification

The first detecting circuit 97 and the second detecting circuit 98 described in the above first and second embodiments and the power-generation-state detecting portion 91' described in the above third embodiment can be combined with each other appropriately to generate power.

In other words, the state of generating power may be detected by any of combinations of the electromotive voltage Vgen and the power generation duration time, the power generation duration time and the frequency of the generated power, the frequency of the generated power and the electromotive voltage Vgen, and the electromotive voltage Vgen, the power generation duration time and the frequency of the generated power.

Further, the parameter to be detected may be the electromotive voltage, or the charging current described in the modification of the second embodiment.

Stated otherwise, the state of generating power can be detected by using any one of detection based on a voltage, detection based on a current, detection based on a power generation duration time, and detection based on frequency of the generated power.

[5.7] Seventh Modification

In the first detecting circuit 97 and the second detecting circuit 98 described in the above first and second embodiments and the power-generation-state detecting portion 91' described in the above third embodiment, the setting value as a comparison reference is changed depending on the current mode. However, the detected result may be compared with a plurality of setting values to detect the state of not generating power (the state not carried by the user), the state carried by the user, and the state of forcibly generating power.

[5.8] Eighth Modification

While the reference potential (GND) is set to Vdd (higher potential side) in each of the above-described embodiments, it is a matter of choice that the reference potential (GND) may be set to Vss (lower potential side).

In this case, the setting voltage value Vo and Vbas each represent a potential difference relative to a detection level set on the higher voltage side with Vss being a reference.

[5.9] Ninth Modification

In each of the above-described embodiments, the shift from the indication mode to the power saving mode is made upon detecting the state where the timepiece is carried by the user. However, the present invention is not limited to those embodiments, the shift from the indication mode to the power saving mode may be executed in accordance with an instruction from the user.

For example, manipulation of a button, a crown or the like arranged on an outer case of the timepiece 1 may be detected to shift the mode from the indication mode to the power saving mode in accordance with a detection result.

In this case, since the mode can be shifted to the power saving mode at once upon intentional manipulation of the user, power saving is also achievable when the user is just wearing the timepiece with no need of knowing the indicated time. As a result, power consumption can be further reduced, and the timepiece can keep the precise time for a longer period of time.

[5.10] Tenth Modification

While the power supply unit B performs half-wave rectification of the AC voltage supplied from the power generation unit A in each of the above-described embodiments, the present invention is not limited to those embodiments. Of course, the power supply unit B may perform full-wave rectification.

[5.11] Eleventh Modification

The above description has been made in connection with only electronic equipment having power generators. For another type of electronic equipment not having a power generator but a power supply unit, e.g., a primary battery, capable of accumulating electric energy, however, the electronic equipment can be constructed so as to detect whether it is carried by the user, and to effect the shift to the power saving mode or the shift from the power saving mode to the normal operating mode.

INDUSTRIAL APPLICABILITY

As described hereinabove, the portable electronic equipment of the present invention includes a carried-by-user detector for detecting whether the electronic equipment is in a state carried by the user or not. When the electronic equipment is in a state not carried by the user, i.e., when the user is not employing the electronic equipment, the operating mode is shifted from the normal operating mode to the power saving mode to reduce power consumption of the electronic equipment.

Accordingly, useless consumption of power during non-use of the electronic equipment can be reduced.

Further, the electronic equipment of the present invention includes a power generator for generating power by converting first energy (=kinetic energy, thermal energy, pressure, optical energy or electromagnetic wave energy) into electric energy as second energy, and a carried-by-user detector for detecting whether the electronic equipment is in a state carried by the user. The operating mode is shifted between the power saving mode and the normal operating mode (the indication mode in the above embodiments) depending on a power generation state or in combination with the state carried with the user.

Therefore, at least when the power generator is not in the state of generating power, the operation of the electronic equipment is stopped to cut back on useless consumption of power. Moreover, if the electronic equipment is not in the state carried by the user even with the power generator being in the state of generating power, the operating mode is shifted to the power saving mode and power consumption is further reduced.

Also, the timepiece as one form of the electronic equipment of the present invention includes a power generator capable of converting first energy (=kinetic energy, thermal energy, pressure, optical energy or electromagnetic wave energy) into electric energy as second energy. The timepiece determines whether the timepiece is carried by the user or not based on whether the power generator is generating power or not, or determines whether the timepiece is carried by the user or not by using any of various carried-state detecting sensors such as an acceleration sensor. When the timepiece is carried by the user, the operating mode is always set to the indication mode in which the time is indicated. When the timepiece is not carried by the user, the time indication is stopped to save energy if the condition that a predetermined non-power-generation time has elapsed is satisfied.

Accordingly, even in the night or the winter, the timepiece as one form of the electronic equipment of the present invention can indicate the time whenever the user is wearing the timepiece and wants to see the time, thereby keeping the user from feeling inconvenienced. On the other hand, when the timepiece is not carried by the user and there is no chance for the user to see the time, the indication is stopped even with light surroundings, whereby energy can be saved. As a result, it is possible to provide the electronic equipment (timepiece) and the control method for the same with which the time can be indicated with good accuracy for a long time without using any battery and without inconveniencing the user.

What is claimed is:

1. Portable electronic equipment comprising:

a power supply device capable of accumulating electric energy, a driven device driven with electric power supplied from said power supply device, a carrying-on-user detector for detecting whether said electronic equipment is in a state carried with a user or not, and a mode shift control device for shifting an operating mode of said driven device from a normal operating mode to a power saving mode in accordance with a detection result of said carrying-on-user detector when said electronic equipment is in a state not carried with the user, for thereby reducing power consumption of said driven device, and wherein said power supply device includes a power generator for generating electric power by converting first energy into the electric energy as second energy, and said power supply device is able to accumulate the generated power, and wherein said carrying-on-user detector detects whether said electronic equipment is in the state carried with the user or not in accordance with a power generation state of said power generator.

2. Electronic equipment according to claim 1, further comprising:

an operating condition restoring device for, when the operating mode is restored to the normal operating mode again after a shift to the power saving mode, restoring an operating condition of said driven device to the same operating condition as resulted in the case of operating said driven device continuously for a period of time elapsed from the shift to the power saving mode to the time of restoring to the normal operating mode.

3. Electronic equipment according to claim 2, wherein:

said mode shift control device shifts the operating mode to the power saving mode when an amount of power accumulated in said power supply device is not less than a predetermined amount of power which is set beforehand and corresponds to the amount of power for said restoring of the operating condition.

4. Electronic equipment according to claim 2, wherein:

said carrying-on-user detector detects the carried state of said electronic equipment based on an electromotive voltage produced in said power generator.

5. Electronic equipment according to claim 4, wherein:

said carrying-on-user detector compares an electromotive voltage produced in said power generator with a plurality of setting voltage values, and detects the carried state of said electronic equipment in accordance with a comparison result.

6. Electronic equipment according to claim 5, wherein:

said carrying-on-user detector detects the carried state of said electronic equipment by selecting one of said plurality of setting voltage values depending on the current mode, and comparing the electromotive voltage produced in said power generator with the selected setting voltage value.

7. Electronic equipment according to claim 6, wherein:

said carrying-on-user detector sets the setting voltage value, which is used for determining whether said operating mode is to be shifted from the power saving mode to the normal operating mode, to be higher than the setting voltage value used for determining whether said operating mode is to be shifted from the normal operating mode to the power saving mode.

8. Electronic equipment according to claim 1, wherein:

said carrying-on-user detector detects the carried state of said electronic equipment based on a charging current in said power supply device.

9. Electronic equipment according to claim 8, wherein:

said carrying-on-user detector compares the charging current in said power supply device with a plurality of setting current values, and detects the carried state of said electronic equipment in accordance with a comparison result.

10. Electronic equipment according to claim 9, wherein:

said carrying-on-user detector detects the carried state of said electronic equipment by selecting one of said plurality of setting current values depending on the current mode, and comparing the charging current in said power supply device with the selected setting current value.

11. Electronic equipment according to claim 10, wherein:

said carrying-on-user detector sets the setting current value, which is used for the mode shift from the power saving mode to the normal operating mode, to be higher than the setting current value used for the shift from the normal operating mode to the power saving mode.

12. Electronic equipment according to claim 1, wherein:

said carrying-on-user detector detects the carried state of said electronic equipment based on a power generation duration time of said power generator.

13. Electronic equipment according to claim 12, wherein:

said carrying-on-user detector compares the power generation duration time of said power generator with a plurality of setting time values, and detects the carried state of said electronic equipment in accordance with a comparison result.

14. Electronic equipment according to claim 13, wherein:

said carrying-on-user detector detects the carried state of said electronic equipment by selecting one of said plurality of setting time values depending on the current mode, and comparing the power generation duration time of said power generator with the s elected set ting time value.

15. Electronic equipment according to claim 14, wherein:

said carrying-on-user detector sets the setting time value, which is used for the mode shift from the power saving mode to the normal operating mode, to be longer than the setting time value used for the shift from the normal operating mode to the power saving mode.

16. Electronic equipment according to claim 1, wherein:

said carrying-on-user detector detects the carried state of said electronic equipment based frequency of the power generated by said power generator.

17. Electronic equipment according to claim 16, wherein:

said carrying-on-user detector detects the frequency of the power generated by said power generator by counting the number of peaks of an electromotive voltage produced in said power generator during a period until a setting time elapses from a point in time at which the electromotive voltage has exceeded a setting voltage value.

18. Electronic equipment according to claim 16, wherein:

said carrying-on-user detector compares the frequency of the power generated by said power generator with a plurality of setting frequency values, and detects the carried state of said electronic equipment in accordance with a comparison result.

19. Electronic equipment according to claim 18, wherein:

said carrying-on-user detector detects the carried state of said electronic equipment by selecting one of said plurality of setting frequency values depending on the current mode, and comparing the frequency of the power generated by said power generator with the selected setting frequency value.

20. Electronic equipment according to claim 19, wherein:

said carrying-on-user detector sets the setting frequency value, which is used for determining whether said operating mode is to be shifted from the power saving mode to the normal operating mode, to be higher than the setting frequency value used for determining whether said operating mode is to be shifted from the normal operating mode to the power saving mode.

21. Electronic equipment according to claim 1, wherein:

said power generator includes a plurality of auxiliary power generators for converting said first energy in different forms.

22. Electronic equipment according to claim 1, wherein:

said first energy is any of kinetic energy, pressure energy or thermal energy.

23. Electronic equipment according to claim 1, wherein:

said power generator generates AC electric power by converting kinetic energy as said first energy into electric energy, and said power supply device rectifies and accumulates the generated AC power.

24. Electronic equipment according to claim 23, wherein:

said carrying-on-user detector comprises switching means being switched over in accordance with a cycle of the AC power generated by said power generator, a capacity element for accumulating electric charges in accordance with the switching operation of said switching means, discharge means inserted in a discharge path of said capacity element and discharging the electric charges accumulated in said capacity element, a measuring portion for counting said power generation duration time by measuring a period of time during which a voltage across said capacity element exceeds a predetermined value, and a carrying-on-user detecting portion for detecting the carried state of said electronic equipment based on said power generation duration time.

25. Electronic equipment according to claim 23, wherein:

said carrying-on-user detector detects the carried state of said electronic equipment based on the frequency of the power generated by said power generator.

26. Electronic equipment according to claim 25, wherein:

said carrying-on-user detector detects the frequency of the power generated by said power generator by counting the number of peaks of an electromotive voltage produced in said power generator during a period until a setting time elapses from a point in time at which the electromotive voltage has exceeded a setting voltage value.

27. Electronic equipment according to claim 25, wherein:

said carrying-on-user detector compares the frequency of the power generated by said power generator with a plurality of setting frequency values, and detects the carried state of said electronic equipment in accordance with a comparison result.

28. Electronic equipment according to claim 27, wherein:

said carrying-on-user detector detects the carried state of said electronic equipment by selecting one of said plurality of setting frequency values depending on the current mode, and comparing the frequency of the power generated by said power generator with the selected setting frequency value.

29. Electronic equipment according to claim 23, wherein:

said power generator comprises a rotating weight undergoing swing motion, and a power generation element for generating electromotive forces with the rotary motion of said rotating weight.

30. Electronic equipment according to claim 23, wherein:

said power generator comprises a resilient member to which deformation forces are applied, rotating means undergoing rotary motion due to restoring forces developed by said resilient member going to restore to an original shape, and a power generation element for generating electromotive forces with the rotary motion of said rotating means.

31. Electronic equipment according to claim 23, wherein:

said power generator comprises a piezoelectric device for generating electromotive forces with the piezoelectric effect when subjected to a displacement.

32. Electronic equipment according to claim 1, wherein:

said driven device is a time indicating device for indicating the time with the electric power supplied from said power supply device, and said mode shift control device shifts the operating mode of said time indicating device to the power saving mode in accordance with a power generation state of said power generator, for thereby reducing power consumption of said time indicating device.

33. Electronic equipment according to claim 32, further comprising:

a time indication restoring device for, when the operating mode is restored to a time indication mode as the normal operating mode again after a shift to the power saving mode, restoring a time indicative condition of said time indicating device to the same time indicative condition as resulted in the case of operating said time indicating device continuously for a period of time elapsed from the shift to the power saving mode to the time of restoring to the time indication mode.

34. Electronic equipment according to claim 32, wherein:

the power saving mode stops the time indication in said time indicating device.

35. Electronic equipment according to claim 32, wherein:

said time indicating device comprises an hour- and minute-hand driving device for driving hour and minute hands, and a second hand driving device for driving a second hand, and the power saving mode comprises a first power saving mode in which operation of said second hand driving device is stopped, and a second power saving mode in which operations of said hour- and minute-hand driving device and said second hand driving device are stopped.

36. Electronic equipment according to claim 32, wherein:

said time indicating device is an analog indicating device for mechanically driving analog hands to rotate said hands, and said mode shift control device comprises a power-saving-mode time storage for storing a power-saving-mode duration time during which the power saving mode is continued, and a time restoring portion for restoring the time indication of said analog indicating device based on the power-saving-mode duration time when the operating mode is shifted from the power saving mode to the indication mode.

37. Electronic equipment according to claim 32, wherein:

said mode shift control device has a mode setting function capable of selectively setting one of the power saving mode in which the time indication of said time indicating device is stopped in accordance with the power generation state of the power generator, and the indication mode in which the time is indicated.

38. Portable electronic equipment comprising:

a power supply device capable of accumulating electric energy, a driven device driven with electric power supplied from said power supply device, a carrying-on-user detector for detecting whether said electronic equipment is in a state carried with a user or not, and a mode shift control device for shifting an operating mode of said driven device from a normal operating mode to a power saving mode in accordance with a detection result of said carrying-on-user detector when said electronic equipment is in a state not carried with the user, for thereby reducing power consumption of said driven device, and wherein said power supply device includes a power generator for generating electric power by converting first energy into the electric energy as second energy, and said power supply device is able to accumulate the generated power, and wherein said mode shift control device shifts the operating mode of said driven device to the power saving mode when said electronic equipment is in the not carried state and the power generation state of said power generator is in a predetermined power generation state which is set beforehand and corresponds to the power saving mode.

39. Electronic equipment according to claim 38, wherein:

said carrying-on-user detector includes an acceleration sensor for detecting acceleration generated when said electronic equipment is carried with the user.

40. Electronic equipment according to claim 38, wherein:

said carrying-on-user detector detects the carried state of said electronic equipment by detecting a change in electrode-to-electrode resistance value or electrode-to-electrode capacitance value occurring when said electronic equipment is carried with the user.

41. Electronic equipment according to claim 38, wherein:

said carrying-on-user detector includes a switch portion turning into an on- or off-state when said electronic equipment is carried with the user, and detects the carried state of said electronic equipment in accordance with the on/off state of said switch portion.

42. A control method for electronic equipment comprising a power supply device capable of accumulating electric energy, and a driven device driven with electric power supplied from said power supply device, said control method comprising:

a carrying-on-user detecting step of detecting whether said electronic equipment is in a state carried with a user or not, and a mode shift control step of shifting an operating mode of said driven device from a normal operating mode to a power saving mode in accordance with a result of the detection when said electronic equipment is in a state not carried with the user, for thereby reducing power consumption of said driven device, and wherein said power supply device includes a power generator for generating electric power by converting first energy into the electric energy as second energy, and said carrying-on-user detecting step detects whether said electronic equipment is in the state carried with the user or not in accordance with a power generation state of said power generator.

43. A control method for electronic equipment according to claim 42, further comprising:

an operating condition restoring step of, when the operating mode is restored to the normal operating mode again after a shift to the power saving mode, restoring an operating condition of said driven device to the same operating condition as resulted in the case of operating said driven device continuously for a period of time elapsed from the shift to the power saving mode to the time of restoring to the normal operating mode.

44. A control method for electronic equipment according to claim 43, wherein:

said mode shift control step shifts the operating mode to the power saving mode when an amount of power accumulated in said power supply device is not less than a predetermined amount of power which is set beforehand and corresponds to the amount of power for said restoring of the operating condition.

45. A control method for electronic equipment according to claim 42, wherein:

said driven device is a time indicating device for indicating the time with the electric power supplied from said power supply device, and said normal operating mode is an indication mode causing said time indicating device to indicate the time.

46. A control method for electronic equipment according to claim 42, wherein:

said first energy is any of kinetic energy, pressure energy or thermal energy.

47. A control method for electronic equipment according to claim 42, wherein:

said first energy is optical energy, and said mode shift control step includes the carrying-on-user detecting step of detecting whether said electronic equipment is in the state carried with the user or not, and shifts the operating mode of said driven device to the power saving mode when said electronic equipment is in the not-carried state and the power generation state of said power generator is in a predetermined power generation state which is set beforehand and corresponds to the power saving mode.

48. A control method for electronic equipment comprising a power supply device capable of accumulating electric energy, and a time indicating device capable of indicating the time with electric power supplied from said power supply device, said control method comprising:

a carrying-on-user detecting step of detecting whether said electronic equipment is in a state carried with a user or not, and a mode shift control step of shifting an operating mode of said time indicating device from a normal operating mode to a power saving mode in accordance with a detection result in said carrying-on-user detecting step when said electronic equipment is in a state not carried with the user, for thereby reducing power consumption of said time indicating device, and wherein said power supply device includes a power generator for generating electric power by converting first energy into the electric energy as second energy, and said carrying-on-user detecting step detects whether said electronic equipment is in the state carried with the user or not in accordance with a power generation state of said power generator.

49. A control method for electronic equipment according to claim 48,further comprising:

a time indication restoring step of, when the operating mode is restored to the normal operating mode again after a shift to the power saving mode, restoring a time indicative condition of said time indicating device to the same time indicative condition as resulted in the case of operating said time indicating device continuously for a period of time elapsed from the shift to the power saving mode to the time of restoring to the normal operating mode.

50. A control method for electronic equipment according to claim 49, wherein:

said mode shift control step shifts the operating mode to the power saving mode when an amount of power accumulated in said power supply device is not less than a predetermined amount of power which is set beforehand and corresponds to the amount of power for said restoring of the operating condition.

51. A control method for electronic equipment according to claim 48, wherein:

said mode shift control step includes a power-generation-state determining step of determining whether said power generator is in a state of generating power or not based on whether an electromotive voltage of said power generator is higher than a setting voltage set beforehand, and shifts the operating mode from the power saving mode to an indication mode, in which the time is indicated, in accordance with a result of the determination when said power generator is brought into the state of generating power.

52. A control method for electronic equipment according to claim 48, wherein:

said mode shift control step includes a power-generation-state determining step of determining whether said power generator is in a state of generating power or not based on whether a power generation duration time of said power generator is longer than a setting time set beforehand, and shifts the operating mode from the power saving mode to an indication mode, in which the time is indicated, in accordance with a result of the determination when said power generator is brought into the state of generating power.

53. A control method for electronic equipment according to claim 48, wherein:

the power saving mode stops the time indication in said time indicating device.

54. A control method for electronic equipment according to claim 48, wherein:

said time indicating device comprises an hour- and minute-hand driving device for driving hour and minute hands, and a second hand driving device for driving a second hand, and the power saving mode comprises a first power saving mode in which operation of said second hand driving device is stopped, and a second power saving mode in which operations of said hour- and minute-hand driving device and said second hand driving device are stopped.

55. A control method for electronic equipment comprising a power supply device capable of accumulating electric energy, and a driven device driven with electric power supplied from said power supply device, said control method comprising:

a carrying-on-user detecting step of detecting whether said electronic equipment is in a state carried with a user or not, and a mode shift control step of shifting an operating mode of said driven device from a normal operating mode to a power saving mode in accordance with a result of the detection when said electronic equipment is in a state not carried with the user, for thereby reducing power consumption of said driven device, and wherein said power supply device includes a power generator for generating electric power by converting first energy into the electric energy as second energy, and said mode shift control step includes shifting the operating mode of said driven device to the power saving mode when said electronic equipment is in the not-carried state and the power generation state of said power generator is in a predetermined power generation state which is set beforehand and corresponds to the power saving mode.

* * * * *

UNITED STATES PATENT AND TRADEMARK OFFICE

CERTIFICATE OF CORRECTION

PATENT NO. : 6,320,822 B1
DATED : November 20, 2001
INVENTOR(S) : Makoto Okeya et al.

It is certified that error appears in the above-identified patent and that said Letters Patent is hereby corrected as shown below:

Title page,
Item [56], References Cited, FOREIGN PATENT DOCUMENTS, add
-- 55-63781 5/1980 (JP) --;

Column 37,
Line 50, change "claim 2", to -- claim 1 --; and

Column 38,
Line 48, change "s elected" to -- selected --.

Signed and Sealed this

First Day of April, 2003

JAMES E. ROGAN
*Director of the United States Patent and Trademark Office*